US011851949B2

(12) United States Patent
Lentine et al.

(10) Patent No.: US 11,851,949 B2
(45) Date of Patent: Dec. 26, 2023

(54) MULTIPURPOSE LADDER AND METHOD

(71) Applicant: Werner Co., Greenville, PA (US)

(72) Inventors: Tek Lentine, Elkhart, IN (US); Thomas Parker, Jamestown, PA (US); Clint Badowski, Mercer, PA (US); James Hlebovy, Jefferson, OH (US)

(73) Assignee: Werner Co., Greenville, PA (US)

( * ) Notice: Subject to any disclaimer, the term of this patent is extended or adjusted under 35 U.S.C. 154(b) by 991 days.

(21) Appl. No.: 16/412,014

(22) Filed: May 14, 2019

(65) Prior Publication Data

US 2019/0368271 A1 Dec. 5, 2019

Related U.S. Application Data

(63) and a continuation-in-part of application No. 15/883,958, filed on Jan. 30, 2018, now Pat. No. 11,280,133.

(60) Provisional application No. 62/677,443, filed on May 29, 2018.

(51) Int. Cl.

| | |
|---|---|
| ***E06C 1/32*** | (2006.01) |
| ***E06C 7/42*** | (2006.01) |
| ***E06C 7/50*** | (2006.01) |

(52) U.S. Cl.

CPC ..... *E06C 1/32* (2013.01); *E06C 7/423* (2013.01); *E06C 7/50* (2013.01)

(58) Field of Classification Search

CPC ..... E06C 1/32; E06C 7/423; E06C 7/50

See application file for complete search history.

(56) References Cited

U.S. PATENT DOCUMENTS

| | | | | |
|---|---|---|---|---|
| 164,683 A * | 6/1875 | Hildreth | E06C 1/32 | 182/209 |
| 180,733 A * | 8/1876 | Small, Jr. | E06C 1/32 | 182/213 |
| 181,305 A * | 8/1876 | Bitter | E06C 1/12 | 182/24 |
| 514,223 A * | 2/1894 | Hammon | E06C 1/32 | 182/175 |
| 601,714 A * | 4/1898 | Napier | E06C 1/32 | 182/209 |

(Continued)

FOREIGN PATENT DOCUMENTS

| | | |
|---|---|---|
| DE | 26 45 438 A1 | 10/1976 |
| KR | 20-2010-0003558 | 3/2009 |
| KR | 20110047913 A | 10/2009 |

*Primary Examiner* — Colleen M Chavchavadze
*Assistant Examiner* — Shiref M Mekhaeil
(74) *Attorney, Agent, or Firm* — Fitch, Even, Tabin & Flannery LLP

(57) ABSTRACT

A multipurpose ladder having a first inner section. The ladder has a first articulated hinge and a second articulated hinge. The ladder has a second inner section. The ladder has a first outer section. The ladder has a first locking bar. The ladder has a second outer section. The multipurpose ladder may have a plurality of brackets disposed about outer rails of the outer sections. The brackets provide support to each of the outer rails and strengthens them against bending forces so the rails can be thinner and of lighter weight. The ladder may have an ANSI duty rating of 1A or an ANSI duty rating of 1AA. A method for using a multipurpose ladder. A method for producing a multipurpose ladder.

22 Claims, 19 Drawing Sheets

Visible Brackets

(56) References Cited

U.S. PATENT DOCUMENTS 605,995 A * 6/1898 Cardarelli ..... E06C 1/32 182/26
1,068,805 A * 7/1913 Mosiman ..... B60R 3/00 182/180.1
2,320,144 A * 5/1943 Johnson ..... E06C 7/44 182/201
2,381,525 A * 8/1945 Thompson ..... E06C 1/32 182/22
2,894,670 A * 7/1959 Anderson ..... E06C 7/44 188/174
3,039,186 A * 6/1962 Stoyer ..... E06C 7/085 29/523
3,112,811 A * 12/1963 Moran ..... E06C 7/165 182/120
3,315,762 A * 4/1967 Torrey ..... E06C 1/56 D25/64
4,029,172 A * 6/1977 Green ..... B29D 99/0017 182/46
4,182,431 A * 1/1980 Wing ..... E06C 1/32 182/228.1
4,376,470 A * 3/1983 Ashton ..... E06C 7/08 182/228.2
4,407,045 A * 10/1983 Boothe ..... E05D 11/1007 403/92
4,412,599 A * 11/1983 McCrudden ..... E06C 7/488 182/201
4,415,062 A * 11/1983 Shaw ..... E06C 7/46 182/109
4,550,541 A * 11/1985 Whitlam ..... E04G 1/36 405/203
4,697,305 A 10/1987 Boothe
4,766,664 A * 8/1988 Benedyk ..... E06C 7/087 29/523
4,854,420 A * 8/1989 Juang ..... E06C 7/44 182/166
4,951,780 A * 8/1990 Kim ..... E06C 1/22 182/27
5,074,377 A * 12/1991 Krause ..... E06C 1/22 182/209
5,279,387 A * 1/1994 Swiderski ..... E06C 1/39 182/27
5,450,703 A * 9/1995 Fuhrman ..... E04H 15/34 52/843
5,954,157 A * 9/1999 Grimes ..... E06C 7/08 16/329
6,193,012 B1 * 2/2001 Olivas ..... E06C 7/50 224/257
6,220,389 B1 * 4/2001 Krause ..... E06C 1/22 182/163
6,729,441 B1 * 5/2004 Nahlen ..... E06C 7/48 182/206
6,926,488 B1 * 8/2005 Bolding ..... E21B 19/15 414/22.59
6,994,185 B1 * 2/2006 Hertel ..... E06C 7/00 182/129
7,086,501 B1 * 8/2006 Saulet ..... E06C 1/397 182/127
7,306,075 B2 * 12/2007 Winslow ..... E06C 1/18 182/163
7,424,933 B2 * 9/2008 Weiss ..... E06C 7/42 182/163
7,837,010 B2 * 11/2010 Astor ..... E06C 7/46 182/220
8,186,481 B2 * 5/2012 Moss ..... E06C 1/18 182/25
8,807,277 B1 * 8/2014 Reyna Lerma ..... E06C 7/42 182/108
9,016,434 B2 * 4/2015 Moss ..... E06C 7/46 182/180.1
9,404,305 B1 * 8/2016 Messick ..... E06C 7/16
10,047,561 B1 * 8/2018 Lanzafame ..... E06C 7/44
10,138,679 B2 * 11/2018 Russell ..... E06C 7/185
10,233,692 B2 * 3/2019 Kieffer ..... E06C 1/125
10,753,149 B2 * 8/2020 Kieffer ..... E06C 1/125
10,865,602 B1 * 12/2020 Varshavsky ..... E06C 7/04
D908,924 S * 1/2021 Melton ..... D25/64
11,174,678 B2 * 11/2021 Kieffer ..... E06C 7/08
11,274,494 B2 * 3/2022 Leng ..... E06C 1/22
2003/0221910 A1 * 12/2003 Huang ..... E06C 1/18 182/163
2005/0121261 A1 * 6/2005 Moss ..... E06C 7/423 182/165
2005/0274571 A1 * 12/2005 Simpson ..... E06C 7/083 182/23
2007/0199768 A1 * 8/2007 Duke ..... E06C 1/39 182/21
2009/0229918 A1 * 9/2009 Moss ..... E06C 1/18 182/180.1
2014/0102830 A1 * 4/2014 Ahmed ..... B29C 55/30 264/136
2015/0068842 A1 * 3/2015 Moss ..... E06C 7/44 292/341.15
2015/0376946 A1 * 12/2015 Kurzer ..... E06C 7/44 156/215
2017/0260809 A1 * 9/2017 Leng ..... E06C 7/08
2017/0356244 A1 * 12/2017 Peterson ..... E06C 1/10
2018/0238112 A1 * 8/2018 Era ..... E06C 7/06
2018/0298691 A1 * 10/2018 Cook ..... E06C 7/083
2018/0371835 A1 * 12/2018 Nguyen ..... E06C 1/38
2019/0145170 A1 * 5/2019 Clark ..... E06C 1/12 182/104
2019/0226279 A1 * 7/2019 Beggs ..... E06C 1/18
2019/0383099 A1 * 12/2019 Yeh ..... F16C 11/10
2020/0240210 A1 * 7/2020 Maxfield ..... E06C 7/46

* cited by examiner

Visible Brackets

Bracket Hidden by Foot

Assembled Inner Brackets

Cantilever Bend Test Loading

Outer Rail Hidden

J Lock Reinforcing Plate

MULTIPURPOSE LADDER AND METHOD

CROSS-REFERENCE TO RELATED APPLICATIONS

This is a non-provisional of U.S. provisional patent application Ser. No. 62/677,443 filed May 29, 2018, which and is a continuation-in-part of U.S. patent application Ser. No. 15/883,958 filed Jan. 30, 2018, now U.S. Pat. No. 11,280,133, issued Mar. 22, 2022, both of which are incorporated by reference herein.

FIELD OF THE INVENTION

The present invention is related to a lighter weight MT ladder that has an ANSI duty rating of 1A or a lighter weight MT ladder that has an ANSI duty rating of 1AA. (As used herein, references to the "present invention" or "invention" relate to exemplary embodiments and not necessarily to every embodiment encompassed by the appended claims.) More specifically, the present invention is related to a lighter weight MT ladder that has an ANSI duty rating of 1A or a lighter weight MT ladder that has an ANSI duty rating of 1AA that has thinner rails with brackets positioned at higher bending force locations on the rails when subjected to loads to buttress the rails at the higher bending force locations.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

It is desirable to produce a multipurpose ladder that is as strong as possible and as light as possible. The strength requirement of the multipurpose ladder is controlling with respect to the light weight requirement because the multipurpose ladder must be safe to use and not fail during use. In other words, the ladder could be made to be very light weight, but as soon as someone climbs on it, the ladder bends over or collapses and effectively there is no ladder that can be used for its intended purpose. What is needed is a lighter weight multipurpose ladder which can be used for its intended purpose and meets all the safety requirements required by ANSI.

BRIEF SUMMARY OF THE INVENTION

The present invention pertains to a multipurpose ladder. The ladder comprises a first inner section having a first inner right rail, a first inner left rail in parallel and spaced relation with the first inner right rail and a plurality of first inner rungs attached to the first inner left and right rail. The ladder comprises a first articulated hinge attached to the first inner right rail with a first set of fasteners. The ladder comprises a second articulated hinge attached to the first inner left rail with a second set of fasteners. The ladder comprises a second inner section having a second inner right rail, and a second inner left rail in parallel and spaced relation with the second inner right rail and a plurality of second inner rungs attached to the second inner left and right rails. The second inner right rail attached to the first articulated hinge and the second inner left rail attached to the second articulated hinge so the second inner section can rotate about the first and second articulated hinges at least 80° relative to the first inner section. The ladder comprises a first outer section having a first outer right rail, and a first outer left rail in parallel and spaced relation with the first outer right rail and a plurality of first outer rungs attached to the first outer left and right rails. The first outer right rail disposed about the first inner right rail with the first inner right rail sliding up and down relative to the first outer right rail. The first outer right rail having a bend of at least 7° outward relative to the first inner right rail which defines a lower portion below the bend. The ladder comprises a first locking bar attached to the first outer section which locks the first inner right rail in place relative to the first outer right rail in a locked state and allows the first inner right rail to slide relative to the first outer right rail in the unlocked state. The ladder comprises a second outer section having a second outer right rail, and a second outer left rail in parallel and spaced relation with the second outer right rail and a plurality of second outer rungs attached to the second outer left and right rails. The second outer right rail disposed about the second inner right rail with the second inner right rail sliding up and down relative to the second outer right rail. The multipurpose ladder having a weight to length ratio of less than 2.41 lbs/ft as a 14' IAA ANSI duty rated multipurpose ladder or a weight to length ratio of less than 2.27 lbs/ft as a 18' IAA ANSI duty rated multipurpose ladder or a weight to length ratio of less than 2.08 lbs/ft as a 22' IAA ANSI duty rated multipurpose ladder or a weight to length ratio of less than 2.34 lbs/ft as a 26' IAA ANSI duty rated multipurpose ladder or a weight to length ratio of less than 2.0 lbs/ft as a 14' IA ANSI duty rated multipurpose ladder or a weight to length ratio of less than 2.00 lbs/ft as a 18' IA ANSI duty rated multipurpose ladder or a weight to length ratio of less than 1.90 lbs/ft as a 22' IA ANSI duty rated multipurpose ladder or a weight to length ratio of less than 2.00 lbs/ft as a 26' IA ANSI duty rated multipurpose ladder.

The present invention pertains to a multipurpose ladder. The ladder comprises a first inner section having a first inner right rail, a first inner left rail in parallel and spaced relation with the first inner right rail and a plurality of first inner rungs attached to the first inner left and right rail. The ladder comprises a first articulated hinge attached to the first inner right rail with a first set of fasteners. The ladder comprises a second articulated hinge attached to the first inner left rail with a second set of fasteners. The ladder comprises a second inner section having a second inner right rail, and a second inner left rail in parallel and spaced relation with the second inner right rail and a plurality of second inner rungs attached to the second inner left and right rails. The second inner right rail attached to the first articulated hinge and the second inner left rail attached to the second articulated hinge so the second inner section can rotate about the first and second articulated hinges at least 80° relative to the first inner section. The ladder comprises a first outer section having a first outer right rail, and a first outer left rail in parallel and spaced relation with the first outer right rail and a plurality of first outer rungs attached to the first outer left and right rails. The first outer right rail disposed about the first inner right rail with the first inner right rail sliding up and down relative to the first outer right rail. The first outer right rail having a bend of at least 7° outward relative to the first inner right rail which defines a lower portion below the bend. The ladder comprises a first locking bar attached to the first outer section which locks the first inner right rail in place relative to the first outer right rail in a locked state and allows the first inner right rail to slide relative to the first outer right rail in the unlocked state. The ladder comprises a second outer section having a second outer right rail, and a second outer left rail in parallel and spaced relation with the second outer right rail and a plurality of second outer rungs attached to the second outer left and right rails, the second outer right rail disposed about the second inner right rail with the second inner right rail sliding up and down relative to the second outer right rail. The ladder comprises a plurality of brackets disposed about the first outer right rail, and the first outer left rail, and the second outer right rail, and the second outer left rail. The brackets providing support to each of the outer right rails and outer left rails and strengthens them against bending forces. The multipurpose ladder having an ANSI duty rating of 1A and supports 300 lbs. of load without failing.

The present invention pertains to a method for using a multipurpose ladder. The method comprises the steps of moving the ladder to a desired location. There is the step of placing the ladder on ground at the desired location so a user can climb the ladder. The ladder comprises a first inner section having a first inner right rail, a first inner left rail in parallel and spaced relation with the first inner right rail and a plurality of first inner rungs attached to the first inner left and right rail. The ladder comprises a first articulated hinge attached to the first inner right rail with a first set of fasteners. The ladder comprises a second articulated hinge attached to the first inner left rail with a second set of fasteners. The ladder comprises a second inner section having a second inner right rail, and a second inner left rail in parallel and spaced relation with the second inner right rail and a plurality of second inner rungs attached to the second inner left and right rails. The second inner right rail attached to the first articulated hinge and the second inner left rail attached to the second articulated hinge so the second inner section can rotate about the first and second articulated hinges at least 80° relative to the first inner section. The ladder comprises a first outer section having a first outer right rail, and a first outer left rail in parallel and spaced relation with the first outer right rail and a plurality of first outer rungs attached to the first outer left and right rails. The first outer right rail disposed about the first inner right rail with the first inner right rail sliding up and down relative to the first outer right rail. The first outer right rail having a bend of at least 7° outward relative to the first inner right rail which defines a lower portion below the bend. The ladder comprises a first locking bar attached to the first outer section which locks the first inner right rail in place relative to the first outer right rail in a locked state and allows the first inner right rail to slide relative to the first outer right rail in the unlocked state. The ladder comprises a second outer section having a second outer right rail, and a second outer left rail in parallel and spaced relation with the second outer right rail and a plurality of second outer rungs attached to the second outer left and right rails. The second outer right rail disposed about the second inner right rail with the second inner right rail sliding up and down relative to the second outer right rail. The multipurpose ladder having a weight to length ratio of less than 2.41 lbs/ft as a 14' IAA ANSI duty rated multipurpose ladder or a weight to length ratio of less than 2.27 lbs/ft as a 18' IAA ANSI duty rated multipurpose ladder or a weight to length ratio of less than 2.08 lbs/ft as a 22' IAA ANSI duty rated multipurpose ladder or a weight to length ratio of less than 2.34 lbs/ft as a 26' IAA ANSI duty rated multipurpose ladder or a weight to length ratio of less than 2.0 lbs/ft as a 14' IA ANSI duty rated multipurpose ladder or a weight to length ratio of less than 2.00 lbs/ft as a 18' IA ANSI duty rated multipurpose ladder or a weight to length ratio of less than 1.90 lbs/ft as a 22' IA ANSI duty rated multipurpose ladder or a weight to length ratio of less than 2.00 lbs/ft as a 26' IA ANSI duty rated multipurpose ladder.

The present invention pertains to a method for producing a multipurpose ladder. The method comprises the steps of assembling the ladder with a first inner section having a first inner right rail, a first inner left rail in parallel and spaced relation with the first inner right rail and a plurality of first inner rungs attached to the first inner left and right rail. Attaching a first articulated hinge to the first inner right rail with a first set of fasteners. Attaching a second articulated hinge to the first inner left rail with a second set of fasteners. The ladder comprises a second inner section having a second inner right rail, and a second inner left rail in parallel and spaced relation with the second inner right rail and a plurality of second inner rungs attached to the second inner left and right rails. The second inner right rail attached to the first articulated hinge and the second inner left rail attached to the second articulated hinge so the second inner section can rotate about the first and second articulated hinges at least 80° relative to the first inner section. The ladder comprises a first outer section having a first outer right rail, and a first outer left rail in parallel and spaced relation with the first outer right rail and a plurality of first outer rungs attached to the first outer left and right rails. The first outer right rail disposed about the first inner right rail with the first inner right rail sliding up and down relative to the first outer right rail. The first outer right rail having a bend of at least 7° outward relative to the first inner right rail which defines a lower portion below the bend. The ladder comprises a first locking bar attached to the first outer section which locks the first inner right rail in place relative to the first outer right rail in a locked state and allows the first inner right rail to slide relative to the first outer right rail in the unlocked state. The ladder comprises a second outer section having a second outer right rail, and a second outer left rail in parallel and spaced relation with the second outer right rail and a plurality of second outer rungs attached to the second outer left and right rails. The second outer right rail disposed about the second inner right rail with the second inner right rail sliding up and down relative to the second outer right rail. The multipurpose ladder having a weight to length ratio of less than 2.41 lbs/ft as a 14' IAA ANSI duty rated multipurpose ladder or a weight to length ratio of less than 2.27 lbs/ft as a 18' IAA ANSI duty rated multipurpose ladder or a weight to length ratio of less than 2.08 lbs/ft as a 22' IAA ANSI duty rated multipurpose ladder or a weight to length ratio of less than 2.34 lbs/ft as a 26' IAA ANSI duty rated multipurpose ladder or a weight to length ratio of less than 2.0 lbs/ft as a 14' IA ANSI duty rated multipurpose ladder or a weight to length ratio of less than 2.00 lbs/ft as a 18' IA ANSI duty rated multipurpose ladder or a weight to length ratio of less than 1.90 lbs/ft as a 22' IA ANSI duty rated multipurpose ladder or a weight to length ratio of less than 2.00 lbs/ft as a 26' IA ANSI duty rated multipurpose ladder.

The present invention pertains to a method for producing a multipurpose ladder. The method comprises the steps of assembling the ladder with a first inner section having a first inner right rail, a first inner left rail in parallel and spaced relation with the first inner right rail and a plurality of first inner rungs attached to the first inner left and right rail. Attaching a first articulated hinge to the first inner right rail with a first set of fasteners. Attaching a second articulated hinge to the first inner left rail with a second set of fasteners. The ladder comprises a second inner section having a second inner right rail, and a second inner left rail in parallel and spaced relation with the second inner right rail and a plurality of second inner rungs attached to the second inner left and right rails. The second inner right rail attached to the first articulated hinge and the second inner left rail attached to the second articulated hinge so the second inner section can rotate about the first and second articulated hinges at least 80° relative to the first inner section. The ladder comprises a first outer section having a first outer right rail, and a first outer left rail in parallel and spaced relation with the first outer right rail and a plurality of first outer rungs attached to the first outer left and right rails. The first outer right rail disposed about the first inner right rail with the first inner right rail sliding up and down relative to the first outer right rail. The first outer right rail having a bend of at least 70 outward relative to the first inner right rail which defines a lower portion below the bend. The ladder comprises a first locking bar attached to the first outer section which locks the first inner right rail in place relative to the first outer right rail in a locked state and allows the first inner right rail to slide relative to the first outer right rail in the unlocked state. The ladder comprises a second outer section having a second outer right rail, and a second outer left rail in parallel and spaced relation with the second outer right rail and a plurality of second outer rungs attached to the second outer left and right rails. The second outer right rail disposed about the second inner right rail with the second inner right rail sliding up and down relative to the second outer right rail. The multipurpose ladder comprises a plurality of brackets disposed about the first outer right rail, and the first outer left rail, and the second outer right rail, and the second outer left rail. The brackets providing support to each of the outer right rails and outer left rails and strengthens them against bending forces. The multipurpose ladder having an ANSI duty rating of 1A and supports 300 lbs. of load without failing.

The present invention pertains to a multipurpose ladder. The ladder comprises a first inner section having a first inner right rail, a first inner left rail in parallel and spaced relation with the first inner right rail and a plurality of first inner rungs attached to the first inner left and right rail. The ladder comprises a first articulated hinge attached to the first inner right rail with a first set of fasteners. The ladder comprises a second articulated hinge attached to the first inner left rail with a second set of fasteners. The ladder comprises a second inner section having a second inner right rail, and a second inner left rail in parallel and spaced relation with the second inner right rail and a plurality of second inner rungs attached to the second inner left and right rails. The second inner right rail attached to the first articulated hinge and the second inner left rail attached to the second articulated hinge so the second inner section can rotate about the first and second articulated hinges at least 80° relative to the first inner section. The ladder comprises a first outer section having a first outer right rail, and a first outer left rail in parallel and spaced relation with the first outer right rail and a plurality of first outer rungs attached to the first outer left and right rails. The first outer right rail disposed about the first inner right rail with the first inner right rail sliding up and down relative to the first outer right rail, the first outer right rail having a bend of at least 7° outward relative to the first inner right rail which defines a lower portion below the bend. The ladder comprises a first locking bar attached to the first outer section which locks the first inner right rail in place relative to the first outer right rail in a locked state and allows the first inner right rail to slide relative to the first outer right rail in the unlocked state. The ladder comprises a second outer section having a second outer right rail, and a second outer left rail in parallel and spaced relation with the second outer right rail and a plurality of second outer rungs attached to the second outer left and right rails. The second outer right rail disposed about the second inner right rail with the second inner right rail sliding up and down relative to the second outer right rail, the first and second outer right rails and the first and second outer left rails each have a web that is less than 0.041 inches thick. The multipurpose ladder having an ANSI duty rating of at least 1A and supports at least 300 lbs. of load without failing, and passes a cantilever bend test, where a load of 500 lbf is applied at a right angle to a bottom of the first right outer rail of the ladder at a web of the first right outer rail and the first right outer rail of the ladder does not fail.

The present invention pertains to a method for using a multipurpose ladder. The method comprises the steps of moving the ladder to a desired location. There is the step of placing the ladder on ground at the desired location so a user can climb the ladder. The ladder comprises a first inner section having a first inner right rail, a first inner left rail in parallel and spaced relation with the first inner right rail and a plurality of first inner rungs attached to the first inner left and right rail. The ladder comprises a first articulated hinge attached to the first inner right rail with a first set of fasteners. The ladder comprises a second articulated hinge attached to the first inner left rail with a second set of fasteners. The ladder comprises a second inner section having a second inner right rail, and a second inner left rail in parallel and spaced relation with the second inner right rail and a plurality of second inner rungs attached to the second inner left and right rails. The second inner right rail attached to the first articulated hinge and the second inner left rail attached to the second articulated hinge so the second inner section can rotate about the first and second articulated hinges at least 80° relative to the first inner section. The ladder comprises a first outer section having a first outer right rail, and a first outer left rail in parallel and spaced relation with the first outer right rail and a plurality of first outer rungs attached to the first outer left and right rails. The first outer right rail disposed about the first inner right rail with the first inner right rail sliding up and down relative to the first outer right rail. The first outer right rail having a bend of at least 7° outward relative to the first inner right rail which defines a lower portion below the bend. The ladder comprises a first locking bar attached to the first outer section which locks the first inner right rail in place relative to the first outer right rail in a locked state and allows the first inner right rail to slide relative to the first outer right rail in the unlocked state. The ladder comprises a second outer section having a second outer right rail, and a second outer left rail in parallel and spaced relation with the second outer right rail and a plurality of second outer rungs attached to the second outer left and right rails. The second outer right rail disposed about the second inner right rail with the second inner right rail sliding up and down relative to the second outer right rail. The multipurpose ladder comprises a plurality of brackets disposed about the first outer right rail, and the first outer left rail, and the second outer right rail, and the second outer left rail. The brackets providing support to each of the outer right rails and outer left rails and strengthens them against bending forces. The multipurpose ladder having an ANSI duty rating of 1A and supports 300 lbs. of load without failing.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
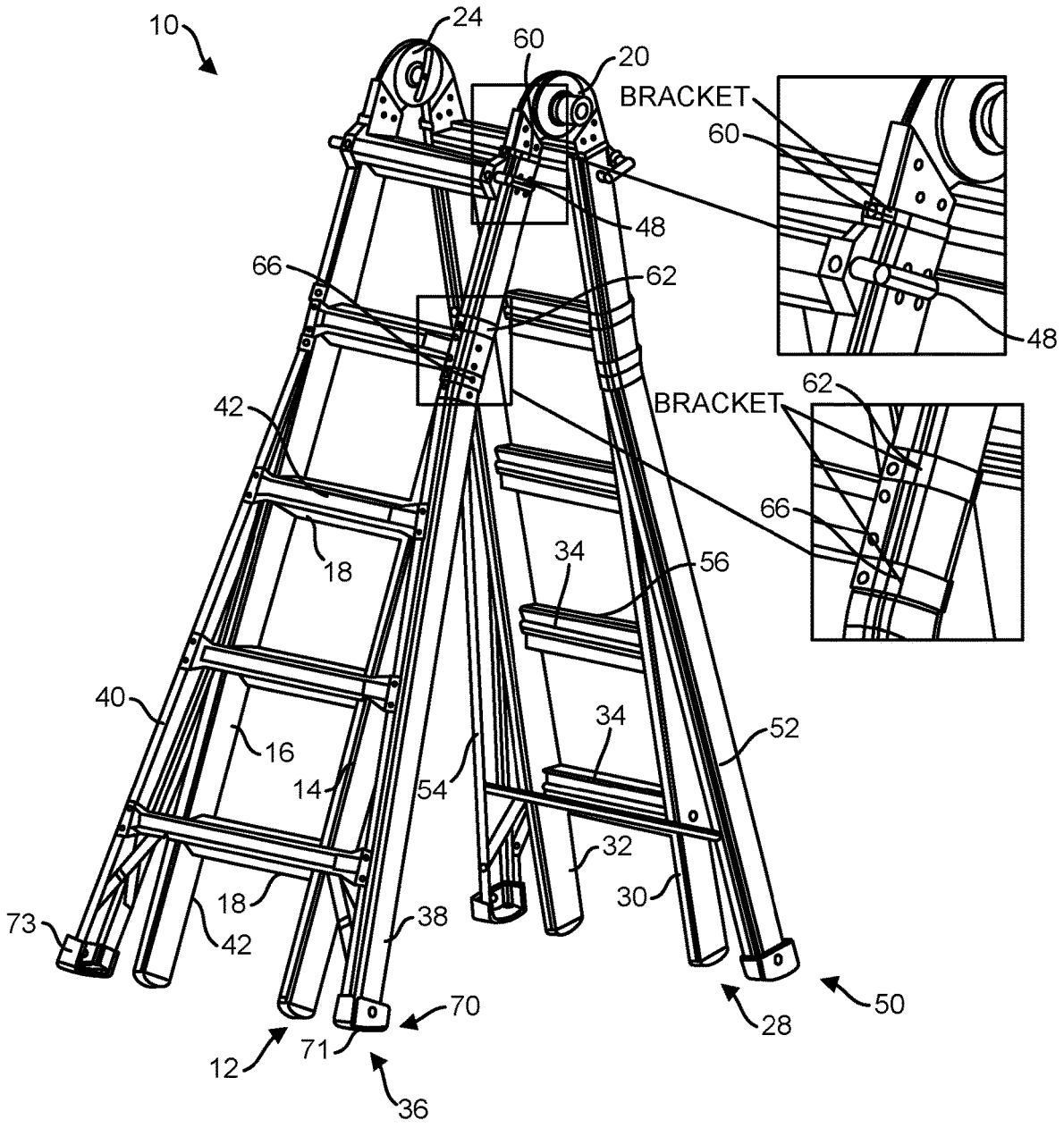
FIG. 1 is a perspective view of the multipurpose ladder of the present invention with the visible brackets shown.
Figure 2:
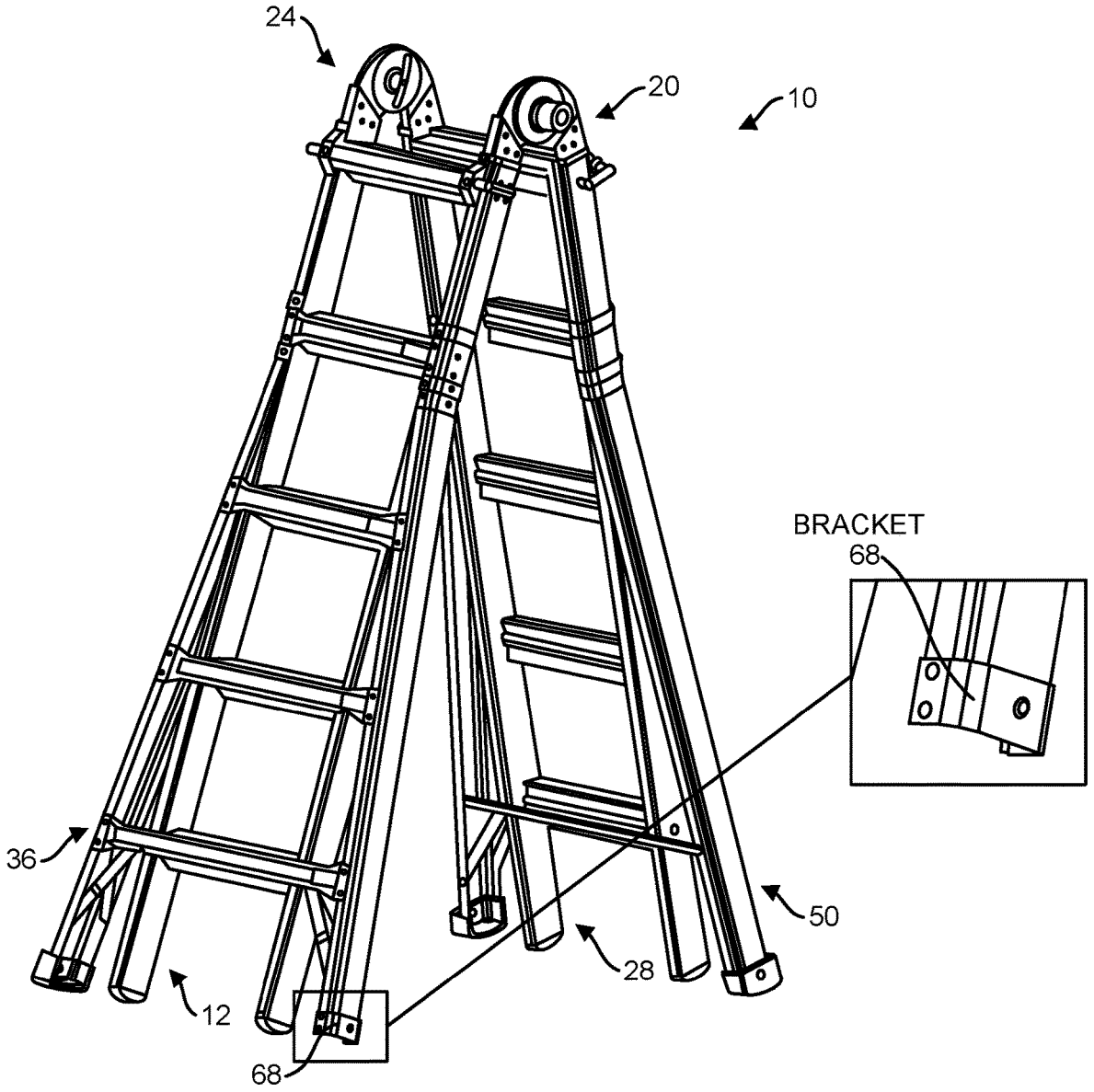
FIG. 2 is a perspective view of the multipurpose ladder with the bracket hidden by the foot shown.
Figure 3:
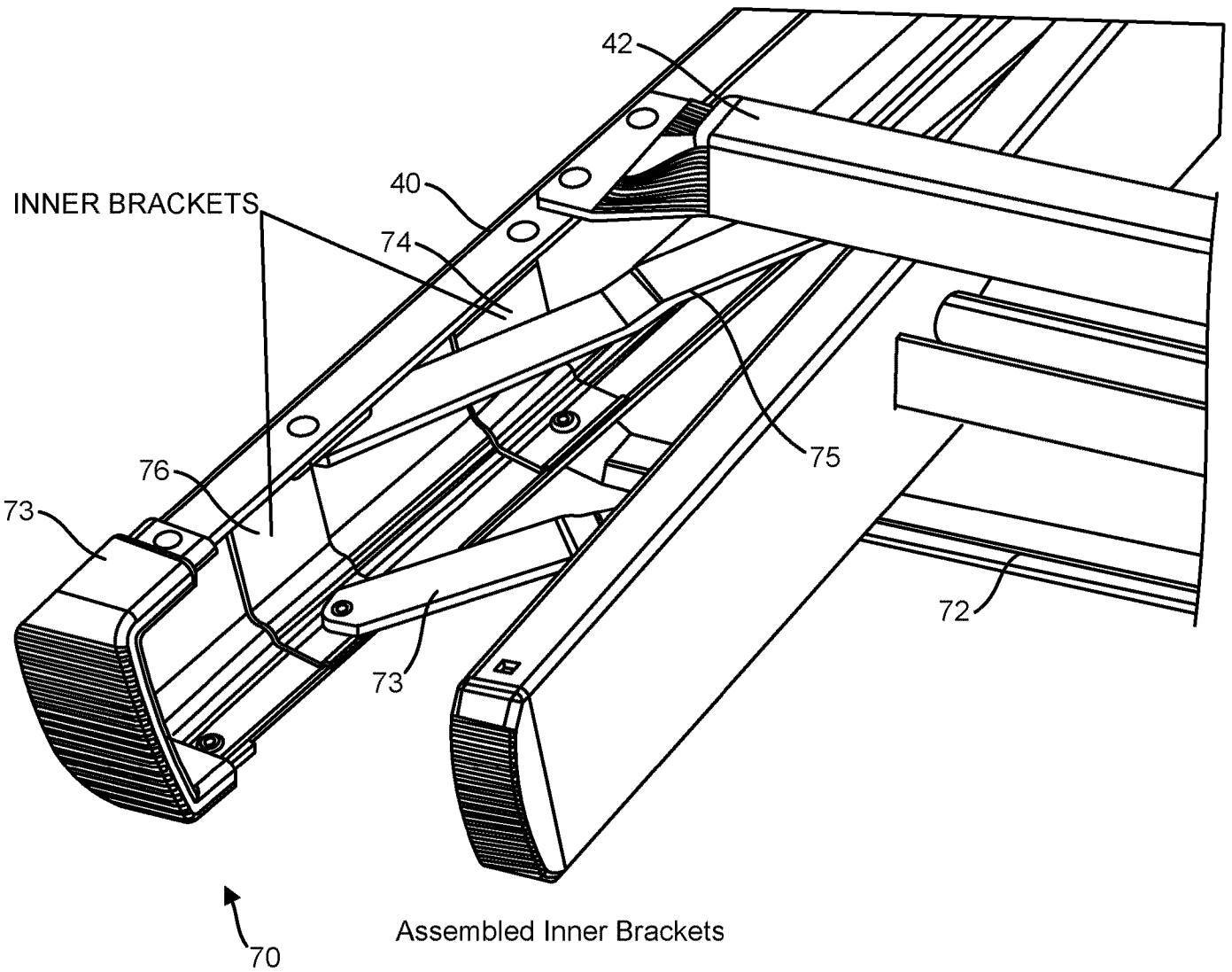
FIG. 3 shows the assembled inner brackets on the first outer left rail.

Referring now to the drawings wherein like reference numerals refer to similar or identical parts throughout the several views, and more specifically to FIGS. 1-3 thereof, there is shown a multipurpose (MT) ladder 10. The ladder 10 comprises a first inner section 12 having a first inner right rail 14, a first inner left rail 16 in parallel and spaced relation with the first inner right rail 14 and a plurality of first inner rungs 18 attached to the first inner left and right rail. The ladder 10 comprises a first articulated hinge 20 attached to the first inner right rail 14 with a first set of fasteners 22. The ladder 10 comprises a second articulated hinge 24 attached to the first inner left rail 16 with a second set of fasteners 26. The ladder 10 comprises a second inner section 28 having a second inner right rail 30, and a second inner left rail 32 in parallel and spaced relation with the second inner right rail 30 and a plurality of second inner rungs 34 attached to the second inner left and right rails. The second inner right rail 30 attached to the first articulated hinge 20 and the second inner left rail 32 attached to the second articulated hinge 24 so the second inner section 28 can rotate about the first and second articulated hinges 20, 24 at least 80° relative to the first inner section 12. The ladder 10 comprises a first outer section 36 having a first outer right rail 38, and a first outer left rail 40 in parallel and spaced relation with the first outer right rail 38 and a plurality of first outer rungs 42 attached to the first outer left and right rails. The first outer right rail 38 disposed about the first inner right rail 14 with the first inner right rail 14 sliding up and down relative to the first outer right rail 38. The first outer right rail 38 having a bend 46 of at least 7° outward relative to the first inner right rail 14 which defines a lower portion 44 below the bend 46. The ladder 10 comprises a first locking bar 48 attached to the first outer section 36 which locks the first inner right rail 14 in place relative to the first outer right rail 38 in a locked state and allows the first inner right rail 14 to slide relative to the first outer right rail 38 in the unlocked state. The ladder 10 comprises a second outer section 50 having a second outer right rail 52, and a second outer left rail 54 in parallel and spaced relation with the second outer right rail 52 and a plurality of second outer rungs 56 attached to the second outer left and right rails. The second outer right rail 52 disposed about the second inner right rail 30 with the second inner right rail 30 sliding up and down relative to the second outer right rail 52. The multipurpose ladder 10 having a weight to length ratio of less than 2.41 lbs/ft as a 14' IAA ANSI duty rated multipurpose ladder or a weight to length ratio of less than 2.27 lbs/ft as a 18' IAA ANSI duty rated multipurpose ladder or a weight to length ratio of less than 2.08 lbs/ft as a 22' IAA ANSI duty rated multipurpose ladder or a weight to length ratio of less than 2.34 lbs/ft as a 26' IAA ANSI duty rated multipurpose ladder or a weight to length ratio of less than 2.0 lbs/ft as a 14' IA ANSI duty rated multipurpose ladder or a weight to length ratio of less than 2.00 lbs/ft as a 18' IA ANSI duty rated multipurpose ladder or a weight to length ratio of less than 1.90 lbs/ft as a 22' IA ANSI duty rated multipurpose ladder or a weight to length ratio of less than 2.00 lbs/ft as a 26' IA ANSI duty rated multipurpose ladder.

Alternatively, the multipurpose ladder may have a weight to length ratio of less than or equal to 2.3 lbs/ft or 2.25 lbs/ft or 2.17 lbs/ft as a 14' IAA ANSI duty rated multipurpose ladder, or a weight to length ratio of less than or equal to 2.23 lbs/ft or 2.18 lbs/ft as a 18' IAA ANSI duty rated multipurpose ladder, or a weight to length ratio of less than or equal to 2.06 lbs/ft as a 22' IAA ANSI duty rated multipurpose ladder, or a weight to length ratio of less than or equal to 2.3 lbs/ft or 2.25 lbs/ft or 2.19 lbs/ft as a 26' IAA ANSI duty rated multipurpose ladder, or a weight to length ratio of less than or equal to 1.95 lbs/ft or 1.90 lbs/ft as a 14' IA ANSI duty rated multipurpose ladder, or a weight to length ratio of less than or equal to 1.94 lbs/ft or 1.88 lbs/ft as a 18' IA ANSI duty rated multipurpose ladder, or a weight to length ratio of less than or equal to 1.85 lbs/ft or 1.81 lbs/ft as a 22' IA ANSI duty rated multipurpose ladder, or a weight to length ratio of less than or equal to 1.95 lbs/ft or 1.93 lbs/ft as a 26' IA ANSI duty rated multipurpose ladder.

Ladders that have an "A" in the rating are heavy duty ladders that can carry heavy loads. IA Ladders can hold up to 300 pounds without failing. This makes it safe to carry a wide range of items up and down the ladder, including heavier items. Some 1A ladders can hold two people at the same time. Type IA ladders are sufficient for most contractor, carpentry, and construction jobs. IAA ladders are the most heavy-duty ladders available. They can support up to 375 pounds without failing. They are great for jobs that require the user to transport extremely heavy items up and down the ladder. ANSI is an acronym for American National Standards Institute. By definition, a ladder that has an ANSI duty rating of IA or IAA has all the necessary features for a user to safely use the ladder and meets all the requirements of the latest ANSI code 2017, incorporated by reference herein. That is, for purposes herein, the weight of the ladder considered for the respective length to weight ratio is the weight of the ladder that has all the necessary features for the ladder to meet all the requirements of the latest ANSI code 2017. By adding brackets 58 in specific locations, the reinforced rails can be lighter weight than is possible without the brackets 58. Furthermore, the MT ladder 10 has achieved a reduced length to weight ratio compared to previously existing MT ladders, and has been realized through the discovery of how to do so while still meeting the requirements and being in conformance with the ANSI code 2017; so, it is not just reducing the weight of any MT ladder but reducing the weight in such a way that a user can safely use the MT ladder 10 because it meets the requirements and is in conformance with ANSI code 2017.

This High Strength MT Ladder 10 has been designed to be the lightest MT ladder in the world and have at least an ANSI rating of IA. To accomplish this, both the inner rail and outer rail walls have been made thinner than existing MT ladders. Additionally, the inner steps, rear cross braces, hinge plates, hinge spacers, and outer feet have been optimized for weight savings by eliminating material or decreasing material thickness in areas where the material is not needed.

The ladder 10 may include a plurality of brackets 58 disposed about the first outer right rail 38, and the first outer left rail 40, and the second outer right rail 52, and the second outer left rail 54. The brackets 58 providing support to each of the outer right rails and outer left rails and strengthens them against bending forces. The brackets 58 are added to the outer rails of MT ladders to add localized strength to the outer rails.

The ladder 10 may include a first bracket 60 of the plurality of brackets 58 disposed about and attached adjacent the top of the first outer right rail 38 above the first locking bar 48. The first bracket 60 having a shape which conforms with a cross sectional shape of the first right outer rail. The first bracket 60 is about 0.5 inches wide and about 0.1 inch thick all around.

The ladder 10 may include a second bracket 62 of the plurality of brackets 58 disposed about the first outer right rail 38 and above and attached adjacent a second highest first outer rung 64 and below the first locking bar 48. The second bracket 62 having a shape which conforms with the cross-sectional shape of the first outer right rail 38.

The ladder 10 may include a third bracket 66 of the plurality of brackets 58 disposed about the first outer right rail 38 and below and attached adjacent the second highest first outer rung 64. The third bracket 66 having a shape which conforms with the cross-sectional shape of the first outer right rail 38. The second and third brackets are about 1 inch wide and 0.1 inch thick all around.

Figure 30:
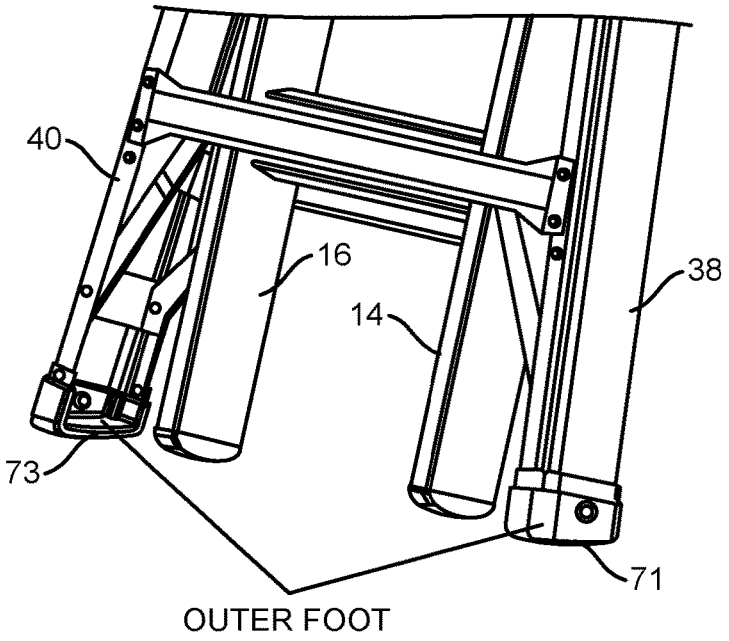
FIG. 30 shows assembled outer feet on the outer rails of the ladder.
Figure 31:
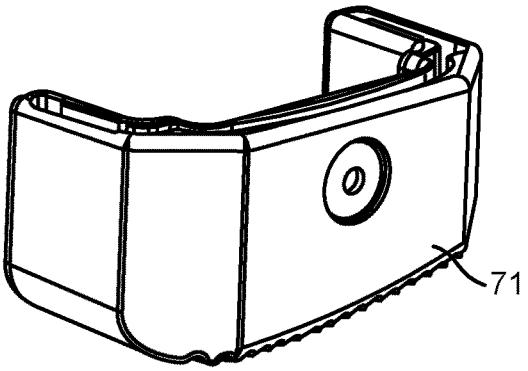
FIG. 31 shows a perspective front view of an outer foot.
Figure 32:
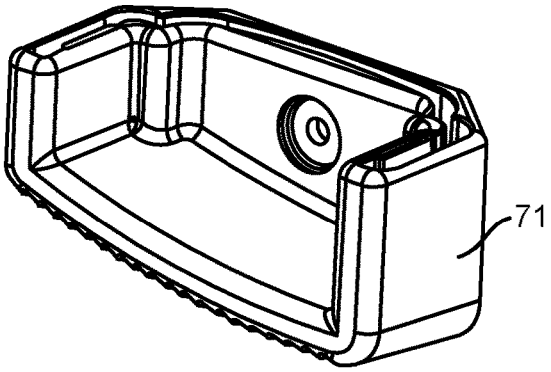
FIG. 32 shows a perspective rear view of the outer foot.
Figure 33:
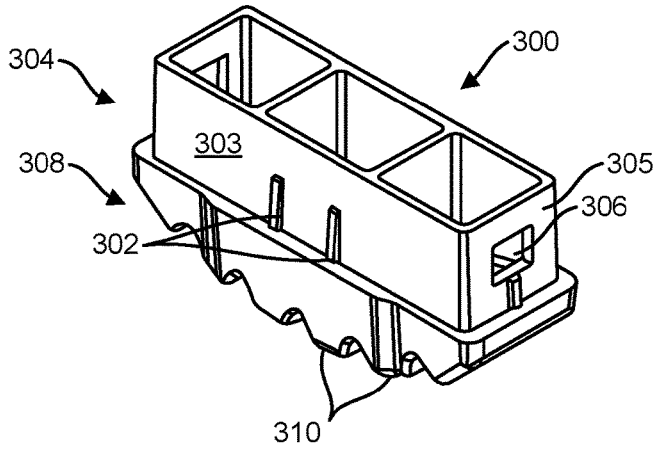
FIG. 33 shows a perspective overhead view of the inner foot.
Figure 34:
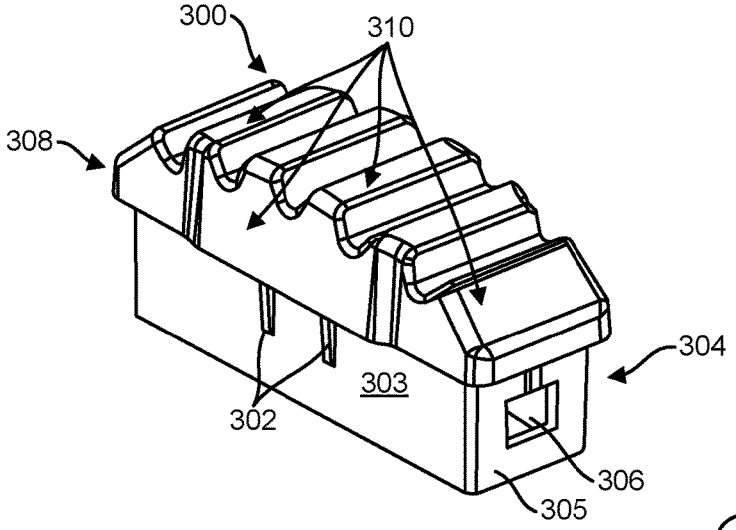
FIG. 34 shows a perspective bottom view of the inner foot.
Figure 35:
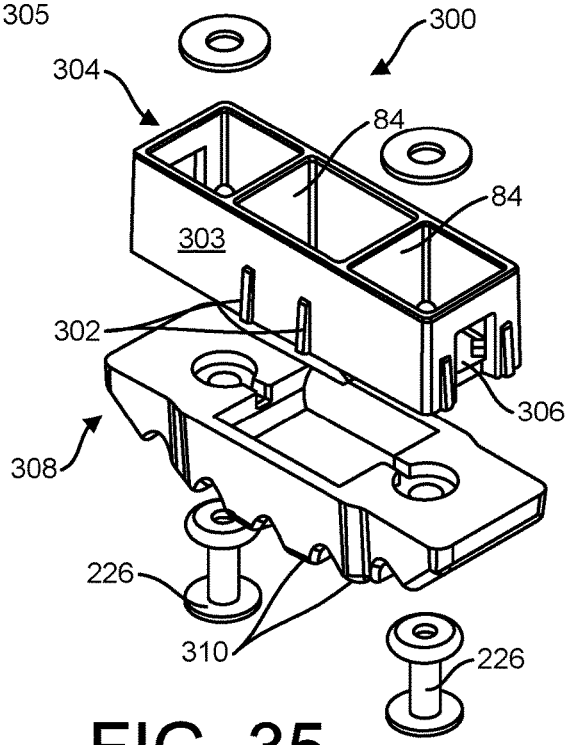
FIG. 35 shows an alternative embodiment of the inner foot.

The ladder 10 may include a fourth bracket 68 of the plurality of brackets 58 disposed about and attached adjacent a bottom 70 of the first outer right rail 38. The fourth bracket 68 having a shape which conforms with the cross-sectional shape of the first outer right rail 38. The fourth bracket 68 may be partially covered by a first outer right foot 71 that fits onto the bottom 70 of the first outer right rail 38, as shown in FIGS. 30-32. The first outer right foot 71, and the first outer left foot 73 that fits onto the bottom 70 of the first outer left rail 40 is made of a one-piece plastic, such as polyurethane. Each first outer foot, and also a second outer right foot and a second outer left foot that fits onto the bottoms of the second outer right rail 52 and second outer left rail 54, respectively, has treads along its bottom surface that context ground for better traction and to prevent slippage of the rails when in use; and has a sleeve in which each respective rail fits into that surrounds the bottom 70 of the respective rail to protect the sides of the respective rail. A single rivet or bolt extends through the sleeve and the respective rail to hold the respective foot to the respective rail. The cross-sectional shape of the sleeve conforms with the cross-sectional shape of the rail. See FIG. 2. With reference to FIGS. 33 and 34, there is shown an inner foot 300 that fits into the bottom of an inner rail. The inner foot 300 has vertical tapered ribs 302 on the outside of the long walls 303 of the upper portion 304 of the inner foot 300. The ribs 302 provide a tight fit with the inner rail. The upper portion 304 has the same cross-sectional rectangular shape of the inner rail, but slightly smaller in width and length so that the upper portion 304 can fit into the inner rail at its bottom. In the short walls 305 of the upper portion 304 is a cutout 306 through which a lance at the bottom of the inner rail extends from the top flange 94 and the bottom flange 96. The lance of the top flange 94 and the bottom flange 96 provides a positive lock with the cutout 306 to prevent the inner foot from falling out of the inner rail. The bottom portion 308 of the inner foot 300 has treads 310 to improve traction of the inner rails on soft surfaces. The upper portion 304 and the bottom portion 308 can be a one-piece plastic or polyvinyl chloride, or can be two separate pieces that are riveted together, as shown in FIG. 35.

Figure 28:
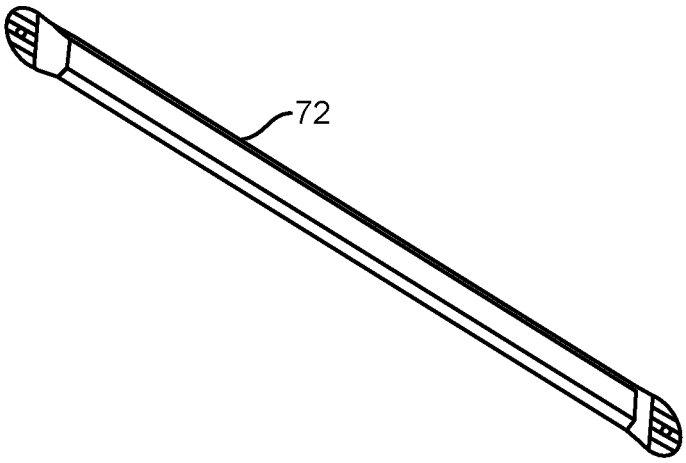
FIG. 28 is a perspective view of a cross brace.

The ladder 10 may include a lower cross brace 72 attached to the first outer right rail 38 and the first outer left rail 40 adjacent a bottom 70 of the first outer right and left rails, as shown in FIGS. 3 and 28, and a fifth bracket 74 of the plurality of brackets 58 disposed inside the first outer right rail 38 and attached to the first outer right rail 38 at a location where the lower cross brace 72 is attached to the first outer right rail 38. The fifth bracket 74 having a shape which conforms with the cross-sectional shape of the first outer right rail 38.

Figure 29:
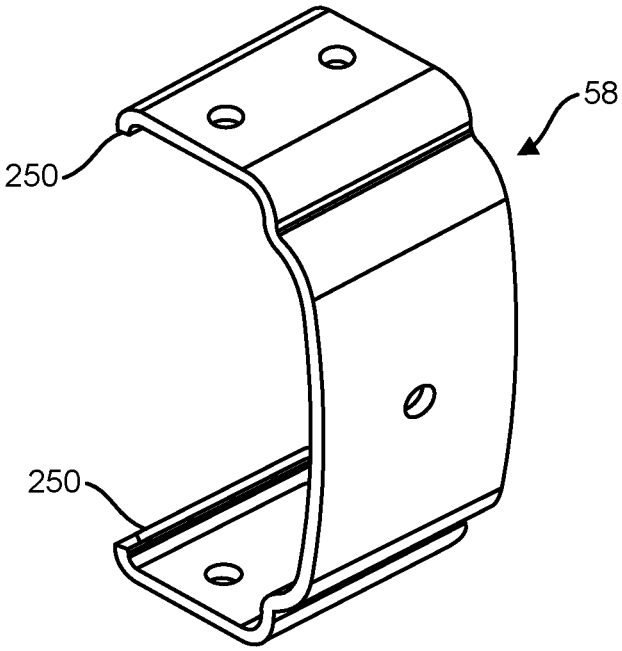
FIG. 29 is a perspective view of a bracket.

The ladder 10 may include a sixth bracket 76 of the plurality of brackets 58 disposed inside the first outer right rail 38 and attached to the first outer right rail 38 below the fifth bracket 74 and above the fourth bracket 68. The sixth bracket 76 having a shape which conforms with the cross-sectional shape of the first outer right rail 38. FIG. 29 is a perspective view of the first through sixth brackets, subject to the dimensions identified for each of them. Each of the brackets have a catch 250 which captures the associated inner rail to prevent it from slipping out of the outer rail during a horizontal bend test. Outer rungs are double riveted to and between the first outer right and left rails, and to and between the second outer right and left rails.

The first articulated hinge 20 may include inner and outer hinge spacers which have bolt holes 80 through which bolts 226 extend to attach the first articulated hinge 20 to the first outer right rail 38 which has localized buttressing 84 about each bolt hole, where the buttressing 84 causes the spacers to be thicker than areas where there is no buttressing 84. The buttressing 84 strengthens the inner and outer hinge spacers against cracking or failure from forces applied to the rivets 226. The fourth, fifth and sixth brackets are about 1.5 inches wide and about 0.1 inch thick all around.

Furthermore, as shown in FIG. 3, a first knee brace 69 extends between and attaches to the lower cross brace 72 and the first outer left rail 40 through the sixth bracket 76, so the sixth bracket 76 receives any forces transmitted from the first knee brace 69 to the first outer left rail 40 through the sixth bracket 76. Similarly, a second knee brace 75 extends between and attaches to the lowest first outer rung 42 and the first outer left rail 40 through the sixth bracket 76, so the sixth bracket 76 receives any forces transmitted from the second knee brace 75 to the first outer left rail 40 through the sixth bracket 76.

The first outer right rail 38 may have a web 86 and a first flange 88 extending perpendicularly from the web 86 and a second flange 90 extending perpendicularly from the web 86 and in parallel and spaced relation with the first flange 88, and wherein the first bracket 60 may have a web 86 and a first flange 88 extending perpendicularly from the web 86 and a second flange 90 extending perpendicularly from the web 86 and in parallel and spaced relation with the first flange 88 of the first bracket 60. The web 86 of the first bracket 60 contacts and conforms with the web 86 of the first outer right rail 38, the first flange 88 of the first bracket 60 contacts and conforms with the first bracket 60 of the first outer right rail 38 and the second flange 90 of the second bracket 62 contacts and conforms with the second flange 90 of the first outer right rail 38. Each of the additional brackets 58, second through sixth also have a web 86, a first flange 88 and a second flange 90 which conform with the web 86, first flange 88 and second flange 90 of the first outer right rail 38 in the same way as described with respect to way the first bracket 60 conforms and the first outer right rail 38.

The hinge plates shown in FIGS. 20-25 have material removed to form cutouts 240 in the stem 224 to reduce weight. The stems 224 engage with the rails through bolts 82 that hold the hinge plates to the rails.

The present invention pertains to a method for using a multipurpose ladder 10. The method comprises the steps of moving the ladder 10 to a desired location. There is the step of placing the ladder 10 on ground at the desired location so a user can climb the ladder 10. The ladder 10 comprises a first inner section 12 having a first inner right rail 14, a first inner left rail 16 in parallel and spaced relation with the first inner right rail 14 and a plurality of first inner rungs 18 attached to the first inner left and right rail. The ladder 10 comprises a first articulated hinge 20 attached to the first inner right rail 14 with a first set of fasteners 22. The ladder 10 comprises a second articulated hinge 24 attached to the first inner left rail 16 with a second set of fasteners 26. The ladder 10 comprises a second inner section 28 having a second inner right rail 30, and a second inner left rail 32 in parallel and spaced relation with the second inner right rail 30 and a plurality of second inner rungs 34 attached to the second inner left and right rails. The second inner right rail 30 attached to the first articulated hinge 20 and the second inner left rail 32 attached to the second articulated hinge 24 so the second inner section 28 can rotate about the first and second articulated hinges 20, 24 at least 80° relative to the first inner section 12. The ladder 10 comprises a first outer section 36 having a first outer right rail 38, and a first outer left rail 40 in parallel and spaced relation with the first outer right rail 38 and a plurality of first outer rungs 42 attached to the first outer left and right rails. The first outer right rail 38 disposed about the first inner right rail 14 with the first inner right rail 14 sliding up and down relative to the first outer right rail 38. The first outer right rail 38 having a bend 46 of at least 7° outward relative to the first inner right rail 14 which defines a lower portion 44 below the bend 46. The ladder 10 comprises a first locking bar 48 attached to the first outer section 36 which locks the first inner right rail 14 in place relative to the first outer right rail 38 in a locked state and allows the first inner right rail 14 to slide relative to the first outer right rail 38 in the unlocked state. The ladder 10 comprises a second outer section 50 having a second outer right rail 52, and a second outer left rail 54 in parallel and spaced relation with the second outer right rail 52 and a plurality of second outer rungs 56 attached to the second outer left and right rails. The second outer right rail 52 disposed about the second inner right rail 30 with the second inner right rail 30 sliding up and down relative to the second outer right rail 52. The multipurpose ladder 10 having a weight to length ratio of less than 2.41 lbs/ft as a 14' IAA ANSI duty rated multipurpose ladder or a weight to length ratio of less than 2.27 lbs/ft as a 18' IAA ANSI duty rated multipurpose ladder or a weight to length ratio of less than 2.08 lbs/ft as a 22' IAA ANSI duty rated multipurpose ladder or a weight to length ratio of less than 2.34 lbs/ft as a 26' IAA ANSI duty rated multipurpose ladder or a weight to length ratio of less than 2.0 lbs/ft as a 14' IA ANSI duty rated multipurpose ladder or a weight to length ratio of less than 2.00 lbs/ft as a 18' IA ANSI duty rated multipurpose ladder or a weight to length ratio of less than 1.90 lbs/ft as a 22' IA ANSI duty rated multipurpose ladder or a weight to length ratio of less than 2.00 lbs/ft as a 26' IA ANSI duty rated multipurpose ladder. Alternatively, the aforementioned different sized multipurpose ladders may have weight to length ratios as described above.

The present invention pertains to a method for using a multipurpose ladder 10. The method comprises the steps of moving the ladder 10 to a desired location. There is the step of placing the ladder 10 on ground at the desired location so a user can climb the ladder 10. The ladder 10 comprises a first inner section 12 having a first inner right rail 14, a first inner left rail 16 in parallel and spaced relation with the first inner right rail 14 and a plurality of first inner rungs 18 attached to the first inner left and right rail. The ladder 10 comprises a first articulated hinge 20 attached to the first inner right rail 14 with a first set of fasteners 22. The ladder 10 comprises a second articulated hinge 24 attached to the first inner left rail 16 with a second set of fasteners 26. The ladder 10 comprises a second inner section 28 having a second inner right rail 30, and a second inner left rail 32 in parallel and spaced relation with the second inner right rail 30 and a plurality of second inner rungs 34 attached to the second inner left and right rails. The second inner right rail 30 attached to the first articulated hinge 20 and the second inner left rail 32 attached to the second articulated hinge 24 so the second inner section 28 can rotate about the first and second articulated hinges 20, 24 at least 80° relative to the first inner section 12. The ladder 10 comprises a first outer section 36 having a first outer right rail 38, and a first outer left rail 40 in parallel and spaced relation with the first outer right rail 38 and a plurality of first outer rungs 42 attached to the first outer left and right rails. The first outer right rail 38 disposed about the first inner right rail 14 with the first inner right rail 14 sliding up and down relative to the first outer right rail 38. The first outer right rail 38 having a bend 46 of at least 7° outward relative to the first inner right rail 14 which defines a lower portion 44 below the bend 46. The ladder 10 comprises a first locking bar 48 attached to the first outer section 36 which locks the first inner right rail 14 in place relative to the first outer right rail 38 in a locked state and allows the first inner right rail 14 to slide relative to the first outer right rail 38 in the unlocked state. The ladder 10 comprises a second outer section 50 having a second outer right rail 52, and a second outer left rail 54 in parallel and spaced relation with the second outer right rail 52 and a plurality of second outer rungs 56 attached to the second outer left and right rails. The second outer right rail 52 disposed about the second inner right rail 30 with the second inner right rail 30 sliding up and down relative to the second outer right rail 52. The multipurpose ladder 10 comprises a plurality of brackets 58 disposed about the first outer right rail 38, and the first outer left rail 40, and the second outer right rail 52, and the second outer left rail 54. The brackets 58 providing support to each of the outer right rails and outer left rails and strengthens them against bending forces. The multipurpose ladder 10 having an ANSI duty rating of IA and supports 300 lbs. of load without failing.

The present invention pertains to a method for producing a multipurpose ladder 10. The method comprises the steps of assembling the ladder 10 with a first inner section 12 having a first inner right rail 14, a first inner left rail 16 in parallel and spaced relation with the first inner right rail 14 and a plurality of first inner rungs 18 attached to the first inner left and right rail. Attaching a first articulated hinge 20 to the first inner right rail 14 with a first set of fasteners 22. Attaching a second articulated hinge 24 to the first inner left rail 16 with a second set of fasteners 26. The ladder 10 comprises a second inner section 28 having a second inner right rail 30, and a second inner left rail 32 in parallel and spaced relation with the second inner right rail 30 and a plurality of second inner rungs 34 attached to the second inner left and right rails. The second inner right rail 30 attached to the first articulated hinge 20 and the second inner left rail 32 attached to the second articulated hinge 24 so the second inner section 28 can rotate about the first and second articulated hinges 20, 24 at least 80° relative to the first inner section 12. The ladder 10 comprises a first outer section 36 having a first outer right rail 38, and a first outer left rail 40 in parallel and spaced relation with the first outer right rail 38 and a plurality of first outer rungs 42 attached to the first outer left and right rails. The first outer right rail 38 disposed about the first inner right rail 14 with the first inner right rail 14 sliding up and down relative to the first outer right rail 38. The first outer right rail 38 having a bend 46 of at least 7° outward relative to the first inner right rail 14 which defines a lower portion 44 below the bend 46. The ladder 10 comprises a first locking bar 48 attached to the first outer section 36 which locks the first inner right rail 14 in place relative to the first outer right rail 38 in a locked state and allows the first inner right rail 14 to slide relative to the first outer right rail 38 in the unlocked state. The ladder 10 comprises a second outer section 50 having a second outer right rail 52, and a second outer left rail 54 in parallel and spaced relation with the second outer right rail 52 and a plurality of second outer rungs 56 attached to the second outer left and right rails. The second outer right rail 52 disposed about the second inner right rail 30 with the second inner right rail 30 sliding up and down relative to the second outer right rail 52. The multipurpose ladder 10 having a weight to length ratio of less than 2.41 lbs/ft as a 14' IAA ANSI duty rated multipurpose ladder or a weight to length ratio of less than 2.27 lbs/ft as a 18' IAA ANSI duty rated multipurpose ladder or a weight to length ratio of less than 2.08 lbs/ft as a 22' IAA ANSI duty rated multipurpose ladder or a weight to length ratio of less than 2.34 lbs/ft as a 26' IAA ANSI duty rated multipurpose ladder or a weight to length ratio of less than 2.0 lbs/ft as a 14' IA ANSI duty rated multipurpose ladder or a weight to length ratio of less than 2.00 lbs/ft as a 18' IA ANSI duty rated multipurpose ladder or a weight to length ratio of less than 1.90 lbs/ft as a 22' IA ANSI duty rated multipurpose ladder or a weight to length ratio of less than 2.00 lbs/ft as a 26' IA ANSI duty rated multipurpose ladder. Alternatively, the aforementioned different sized multipurpose ladders may have weight to length ratios as described above. The rails and rungs and brackets 58 are made of aluminum, and specifically may be either 6061-T6, 6061-T5, or 6005-T5 aluminum alloy.

The present invention pertains to a method for producing a multipurpose ladder 10. The method comprises the steps of assembling the ladder 10 with a first inner section 12 having a first inner right rail 14, a first inner left rail 16 in parallel and spaced relation with the first inner right rail 14 and a plurality of first inner rungs 18 attached to the first inner left and right rail. Attaching a first articulated hinge 20 to the first inner right rail 14 with a first set of fasteners 22. Attaching a second articulated hinge 24 to the first inner left rail 16 with a second set of fasteners 26. The ladder 10 comprises a second inner section 28 having a second inner right rail 30, and a second inner left rail 32 in parallel and spaced relation with the second inner right rail 30 and a plurality of second inner rungs 34 attached to the second inner left and right rails. The second inner right rail 30 attached to the first articulated hinge 20 and the second inner left rail 32 attached to the second articulated hinge 24 so the second inner section 28 can rotate about the first and second articulated hinges 20, 24 at least 80° relative to the first inner section 12. The ladder 10 comprises a first outer section 36 having a first outer right rail 38, and a first outer left rail 40 in parallel and spaced relation with the first outer right rail 38 and a plurality of first outer rungs 42 attached to the first outer left and right rails. The first outer right rail 38 disposed about the first inner right rail 14 with the first inner right rail 14 sliding up and down relative to the first outer right rail 38. The first outer right rail 38 having a bend 46 of at least 7° outward relative to the first inner right rail 14 which defines a lower portion 44 below the bend 46. The ladder 10 comprises a first locking bar 48 attached to the first outer section 36 which locks the first inner right rail 14 in place relative to the first outer right rail 38 in a locked state and allows the first inner right rail 14 to slide relative to the first outer right rail 38 in the unlocked state. The ladder 10 comprises a second outer section 50 having a second outer right rail 52, and a second outer left rail 54 in parallel and spaced relation with the second outer right rail 52 and a plurality of second outer rungs 56 attached to the second outer left and right rails. The second outer right rail 52 disposed about the second inner right rail 30 with the second inner right rail 30 sliding up and down relative to the second outer right rail 52. The multipurpose ladder 10 comprises a plurality of brackets 58 disposed about the first outer right rail 38, and the first outer left rail 40, and the second outer right rail 52, and the second outer left rail 54. The brackets 58 providing support to each of the outer right rails and outer left rails and strengthens them against bending forces. The multipurpose ladder 10 having an ANSI duty rating of IA and supports 300 lbs. of load without failing.

Figure 4:
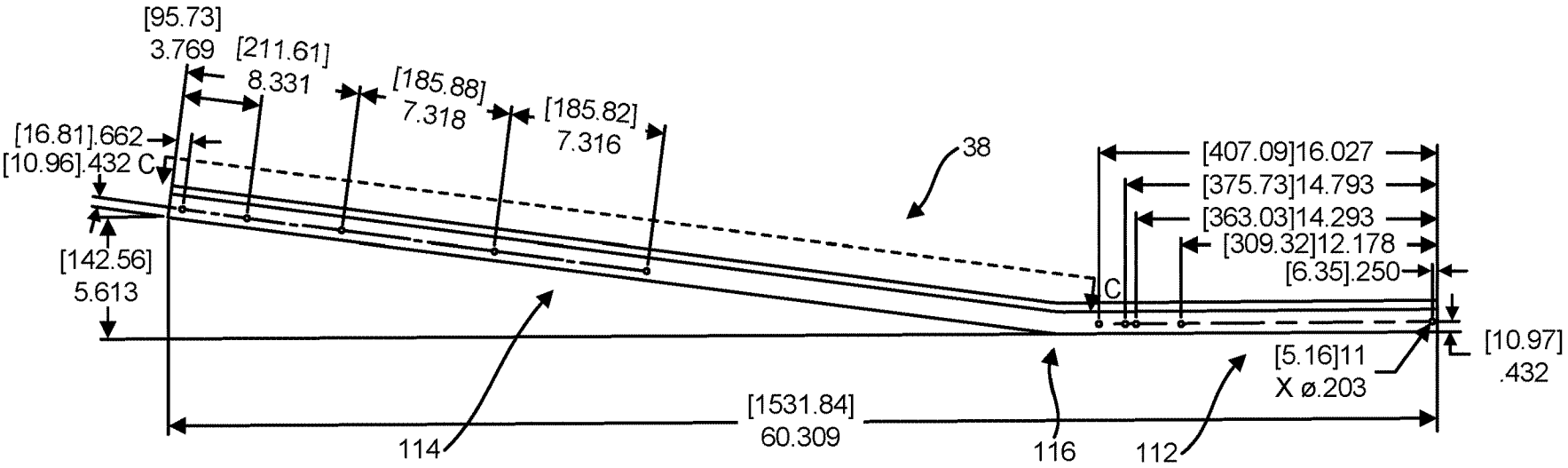
FIG. 4 is a side view of the first outer right rail.
Figure 5:
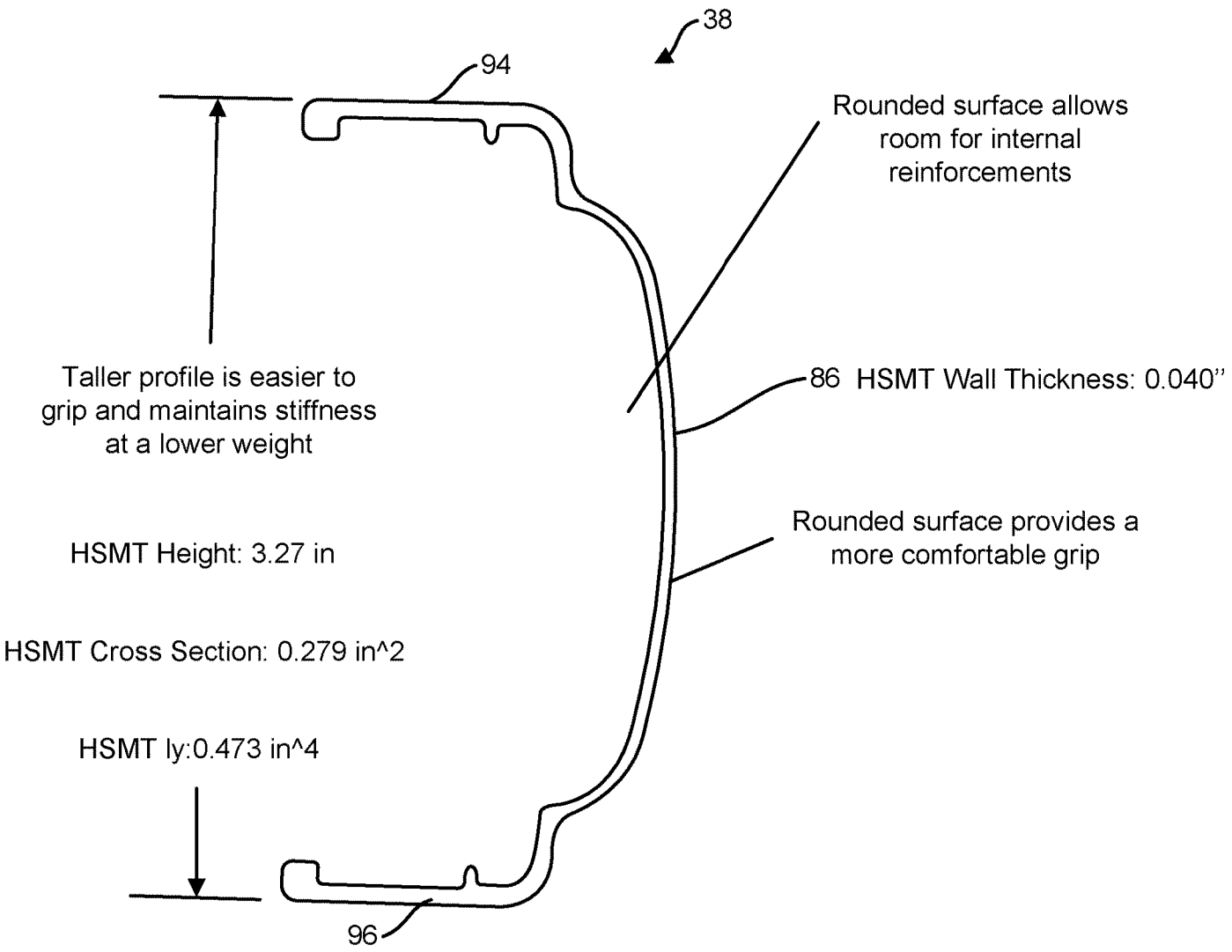
FIG. 5 is a cross-sectional view of the first outer right rail.

Each outer rail has a web 86 that is thinner than 0.041 inches thick, with more than 80% of the web 86 having a rounded surface, as shown in FIGS. 4 and 5. Each outer rail has a height that is at least 3 inches long, with a cross section that is less than 0.3 in^2, and a ly that is greater than 0.45 in^4.

Preferably, each outer rail has a web 86 that is 0.040 inches thick for maximum weight savings for the 14IAA, 18IAA and 22IAA MT ladders, where the 14, 18 and 22 identify the height of the MT ladder 10 in feet, respectively. More than 80% of the web has a rounded surface which allows for internal reinforcement and a more comfortable grip by a user. Preferably each outer rail has a height that is 3.27 inches long, a cross section that is 0.279 in^2, and a ly that is 0.473 in^4. The first flange 88 and second flange 90 of the outer rail are 0.051 inches thick.

Figure 6:
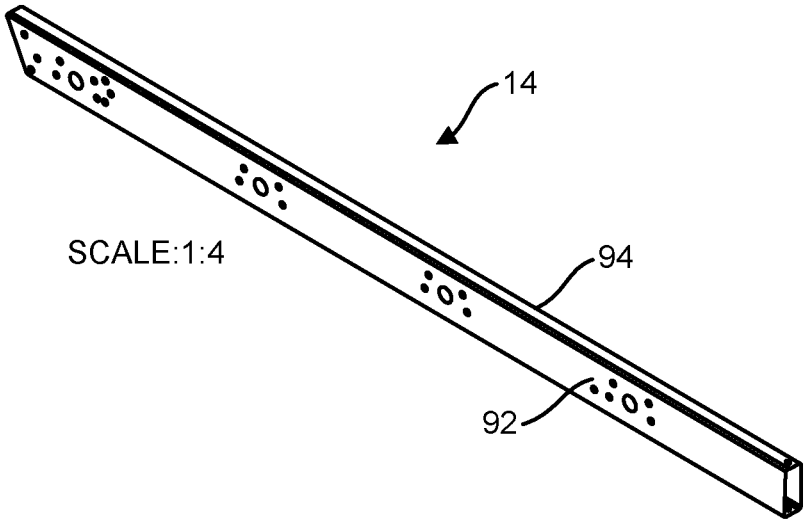
FIG. 6 is a perspective view of the first inner right rail.
Figure 7:
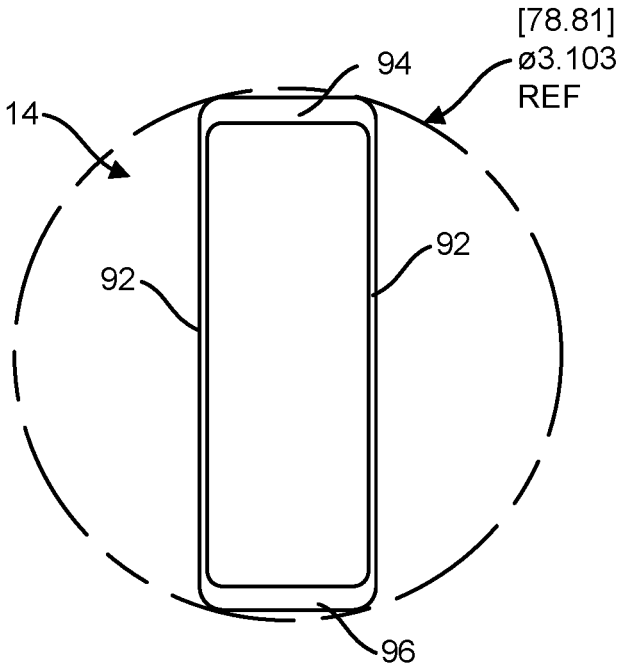
FIG. 7 is a cross-sectional view of the first inner right rail.
Figure 19:
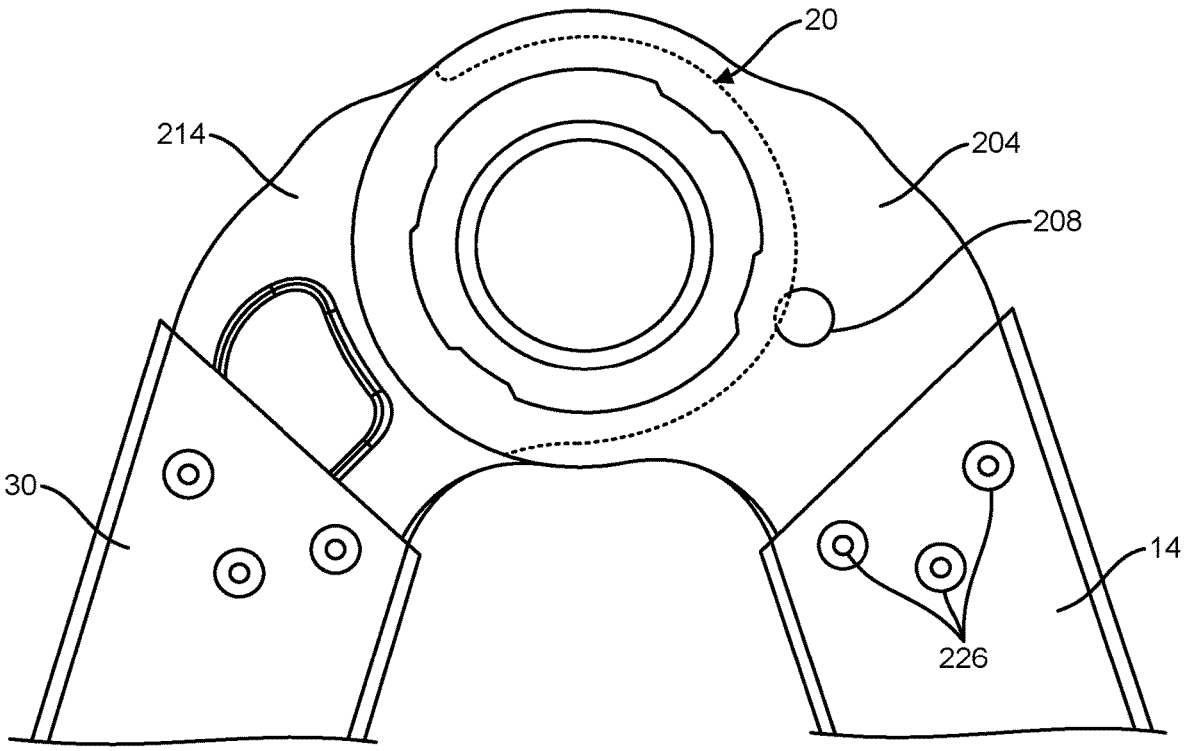
FIG. 19 shows an articulated hinge attached to the first and second inner rails with the safety stop hidden to eliminate a pinch point.
Figure 20:
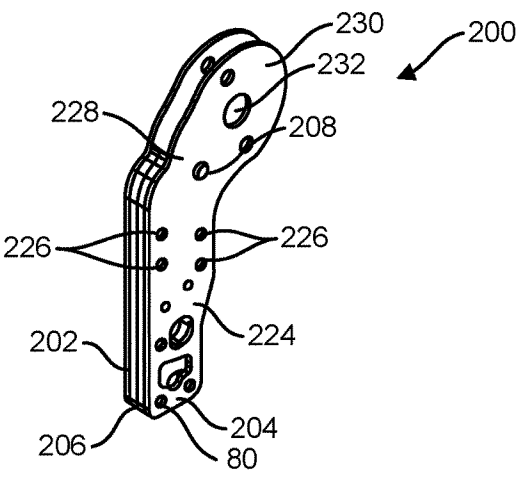
FIG. 20 is a perspective view of the outer hinge plate assembly.
Figure 22:
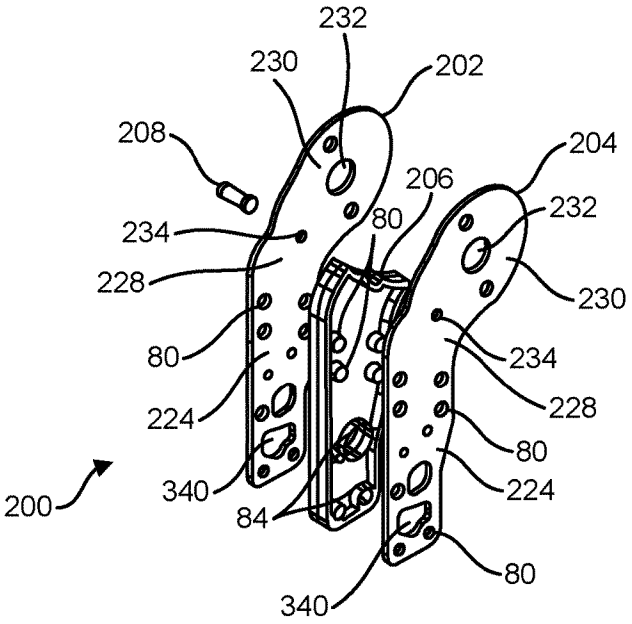
FIG. 22 is an exploded perspective view of the outer hinge plate assembly.
Figure 21:
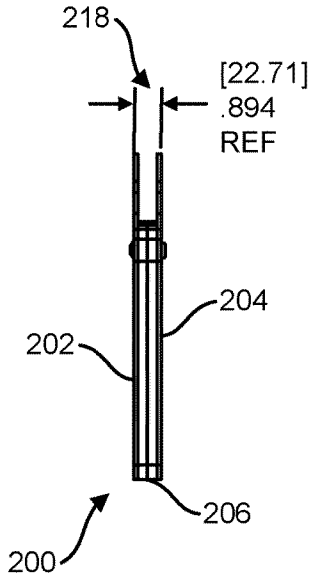
FIG. 21 is a front view of the outer hinge plate assembly.

Each inner rail has a cross-section of a hollow box and has a web 92 that is thinner than 0.041 inches thick, and a height that is at least 2.8 inches long, with a cross section that is less than 0.41 in^2 and a ly that is greater than 0.5 in^4, as shown in FIGS. 6 and 7. Preferably, each inner rail has a right and left web that each is 0.040 inches thick for maximum weight savings and an inner rail top flange 94 and bottom flange 96 that is 0.09 inches thick. Preferably each inner rail has a height that is 3.00 inches long, a cross section that is 0.402 in^2, and a ly that is 0.520 in^4. The right and left webs of the inner rail are in parallel and spaced relation and attach perpendicularly with the inner rail top and bottom flanges to form the hollow box. The top of each inner rail which receives a stem 224 of the hinge 20 is slanted downward and inward at an angle of about 27 degrees, as shown in FIG. 19.

There is a reinforcement plate 99, as shown in FIGS. 9-13, disposed on the inside of each outer rail which extends from an upper section 100 of each outer rail above a bend 102 in each outer rail to at least 4 inches down along the lower section 104 of each outer rail. The reinforcement plate 99 conforms to the shape of the inner surface of outer rail, The reinforcement plate 98 has a web 106 which is curved with the same curve as the web 86 of the outer rail, and a top reinforcement flange 108 and a bottom reinforcement flange 110 attached to the web 106 of the reinforcement plate 99 at the web's 106 ends. The top and bottom reinforcement flanges are about 0.25 inches wide and about 0.22 inches long.

The reinforcing plate 99 was added to the inside of each of the outer rails on the 22IAA and 26IAA models in order to pass the ANSI Single J Lock Test. Moving the material to the ends of the reinforcement plate 99 achieves the needed strength but allows the part to be low profile and fit inside of the outer rail without interfering with the operation of the ladder. The reinforcement plate 99 is disposed on the inside of the outer rail and conforms to the shape of inner surface of outer rail. The reinforcing plate 99 has an upper section 100 that extends about 1.5 inches from above a bend 102, and a lower section 104 that extends about 6.5 inches below the bend 102. The reinforcing plate 99 has a web 106 which is about 0.040 inches thick and a curvature that conforms with and is essentially the same as the curvature of web 86 of the outer rail. The outer rail has an upper section 112 and a lower section 114 and a bend 116 therebetween, and the upper section 100 and the lower section 104 and the bend 102 of the reinforcing plate 99 fits inside the corresponding sections of the outer rail. The reinforcing plate 99 is made of Aluminum 6061-T6, 6005-T5 or an engineering equivalent.

Figure 15:
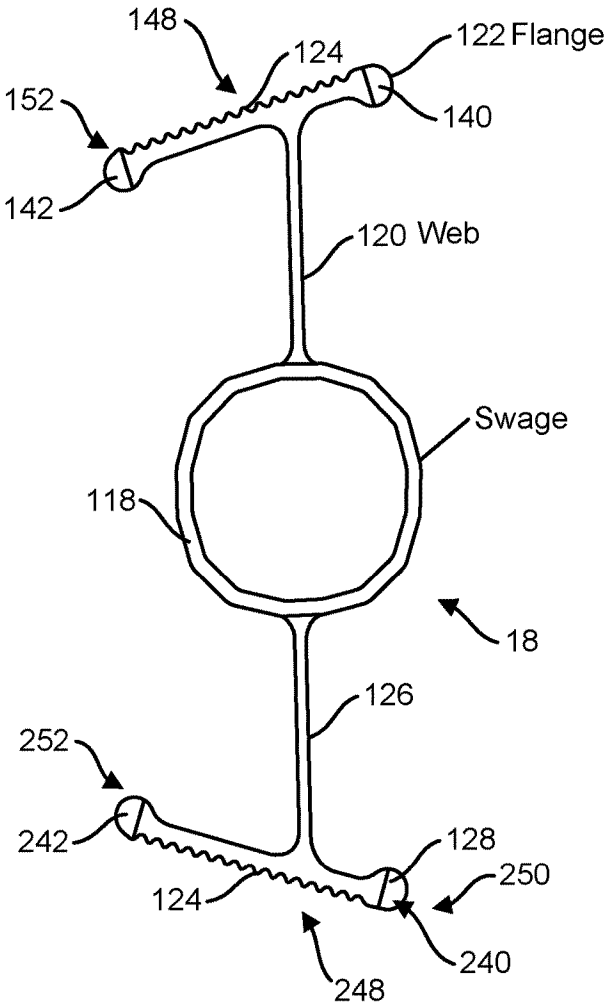
FIG. 15 is a cross-sectional view of the inner rung.
Figure 14:
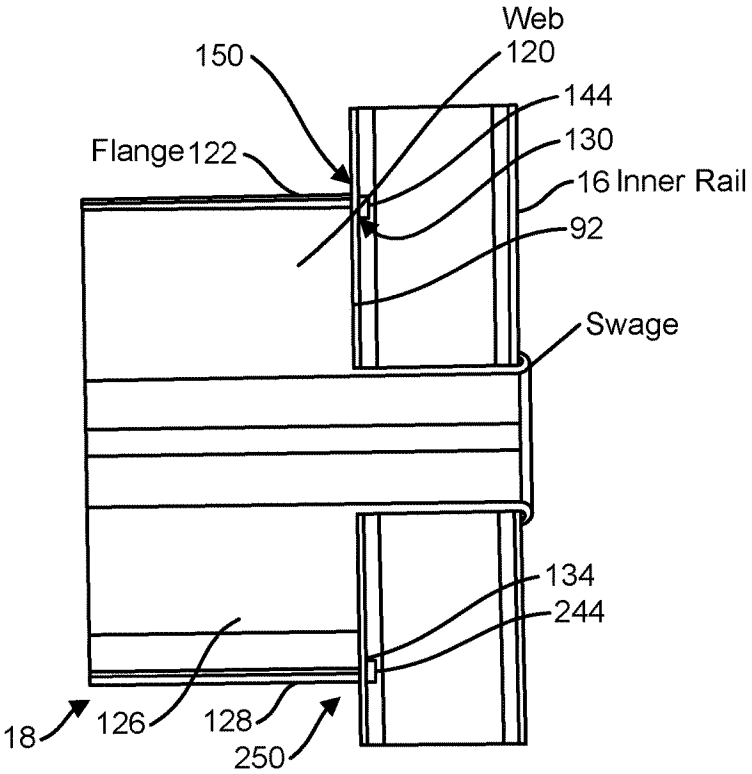
FIG. 14 is a cutaway view of a portion of the inner rung swaged to the inner rail.
Figure 16:
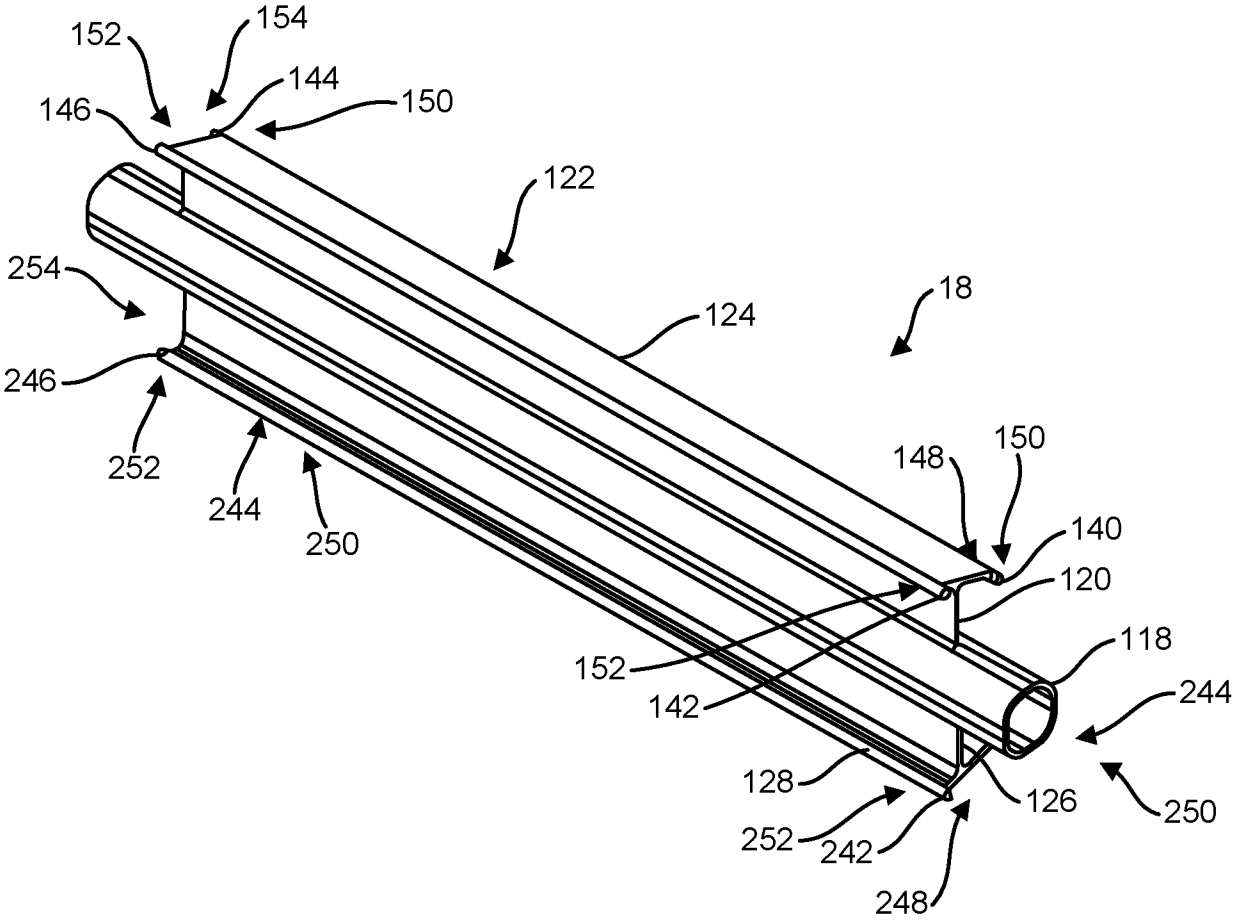
FIG. 16 is a perspective view of the inner rung.

At least one inner rung comprises a hollow center portion 118; a top web 120 which extends upwards from the center portion 118, and a top flange 122 having a flat surface 124 on which a user can place a foot to stand on, as shown in FIGS. 14-16. The top flange 122 is attached to the top web 120 at an acute angle, preferably about 17 degrees, with the top web 120 so the flat surface 124 faces away from a center of the ladder with the top web 120 between the top flange 122 and the center portion 118. The top web 120 is less than 0.041 inches thick. The at least one inner rung comprises a bottom web 126 which extends downwards from the center portion 118, and a bottom flange 128 having a flat surface 124 on which a user can place a foot to stand on. The bottom flange 128 is attached to the bottom web 126 at an acute angle with the bottom web 126 so the flat surface 124 of the bottom flange 128 faces away from the center of the ladder with the bottom web 126 between the bottom flange 128 and the center portion 118. The bottom web 126 is less than 0.041 inches thick. The center portion 118 extends beyond the top and bottom flanges of the one inner rung so the center portion 118 extends through the first inner right rail 14 and the first inner left rail 16 and is swaged to them to fix the one inner rung in place.

Figure 18:
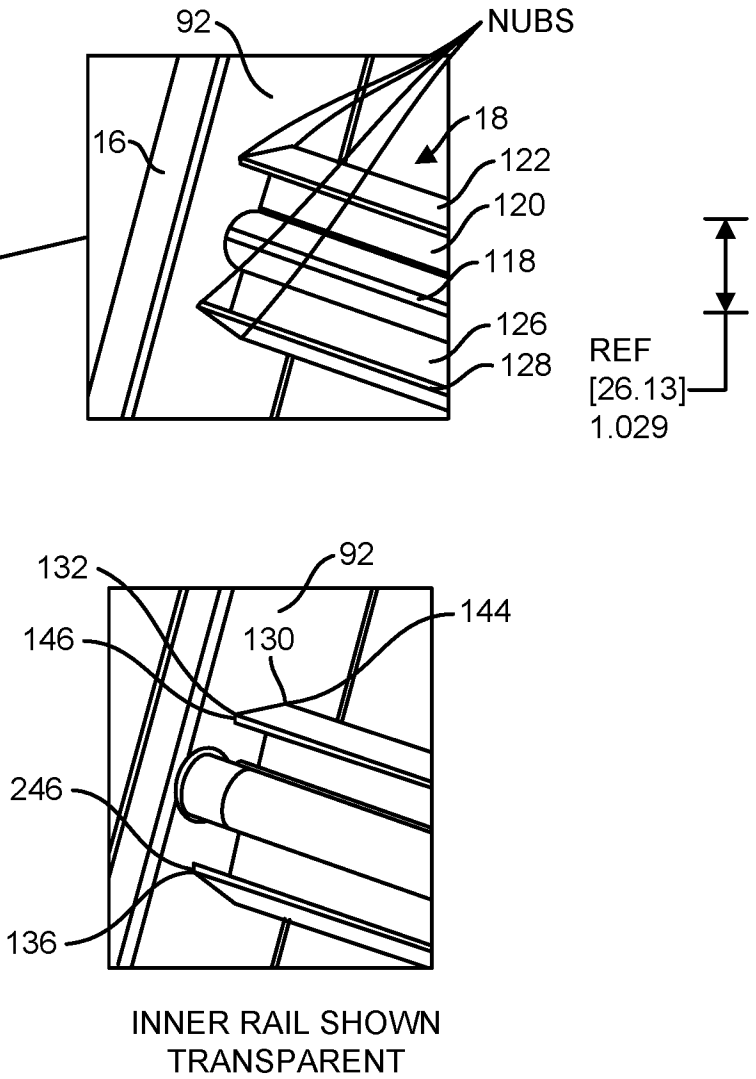
FIG. 18 is an enlarged view of the nubs of the inner rung engaged with the inner rail with a portion of the inner rail removed.
Figure 17:
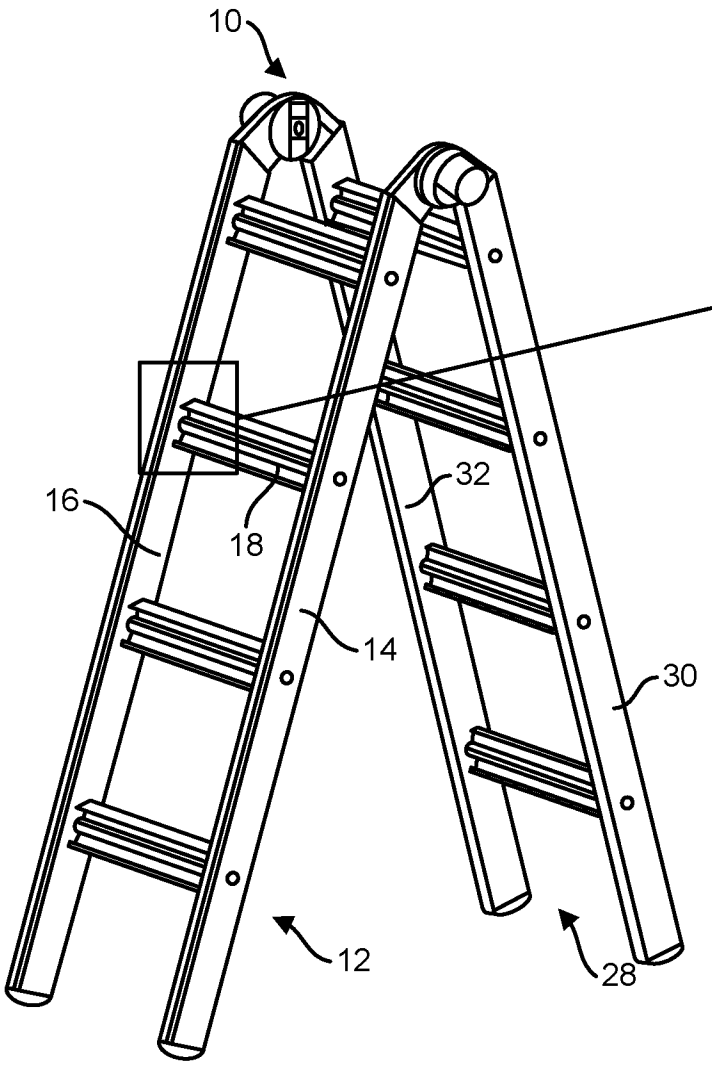
FIG. 17 is a perspective view of the intersections of the multipurpose ladder with an enlarged view of the nubs of the inner rung engaged with an inner rail.

The inner web 92 of the first inner right rail 14 and the first inner left rail 16 has a first hole 130 and a second hole 132 and a third hole 134 and a fourth hole 136, as shown in FIGS. 17 and 18. The top flange 122 of the first inner rung 18 has a first nub 140 that extends from a first end 148 and a first edge 150 of the top flange 122 that engages with the first hole 130 of the inner web 92 of the first inner right rail 14 and a second nub 142 that extends from the first end 148 and a second edge 152 of the top flange 122 that engages with the second hole 132 of the inner web 92 of the first inner right rail 14 and a third nub 144 that extends from a second end 154 and the first edge 150 of the top flange 122 that engages with the first hole 130 of the inner web 92 of the first inner left rail 16 and a fourth nub 146 that extends from the second end 154 and the second edge 152 of the top flange 122 that engages with the second hole 132 of the inner web 92 of the first inner left rail 16. The bottom flange 128 of the first inner rung 18 has a first nub 240 that extends from a first end 248 and a first edge 250 of the bottom flange 128 that engages with the third hole 134 of the inner web 92 of the first inner right rail 14 and a second nub 142 that extends from the first end 248 and a second edge 252 of the bottom flange 128 that engages with the fourth hole 136 of the inner web 92 of the first inner right rail 14 and a third nub 244 that extends from a second end 254 and the first edge 250 of the bottom flange 128 that engages with the third hole 134 of the inner web 92 of the first inner left rail 16 and a fourth nub 246 that extends from the second end 254 and the second edge 252 of the bottom flange 128 that engages with the fourth hole 136 of the inner web 92 of the first inner left rail 16.

The inner rung has been optimized to move material away from the centroid of the part (thinner webs and swage, thicker flanges) to facilitate a lighter weight design that still passes ANSI codes for step strength. Additionally, there are four nubs at the end of the inner rung that engage holes in the inner rail. Without this engagement, the step collapses during the step-to-side rail shear ANSI test.

Figure 24:
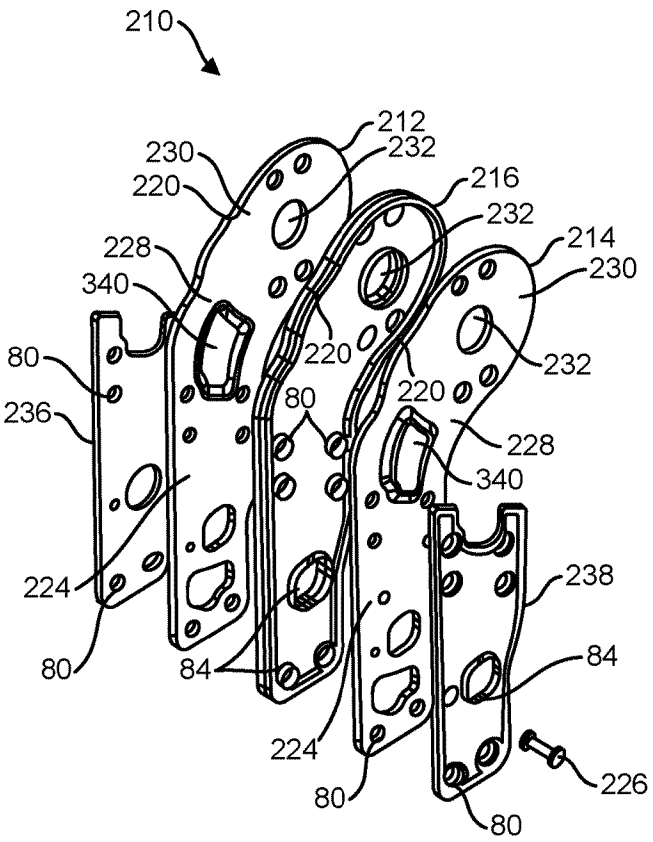
FIG. 24 is an exploded perspective view of the inner hinge plate assembly.
Figure 23:
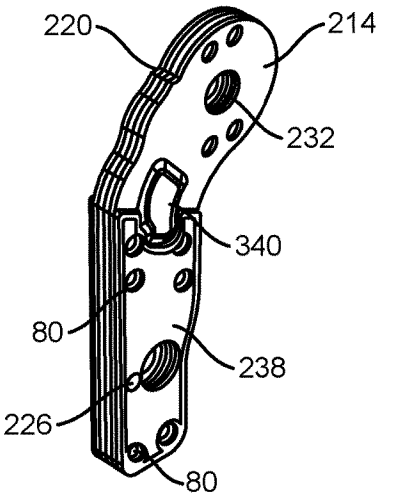
FIG. 23 is a perspective view of the inner hinge plate assembly.
Figure 25:
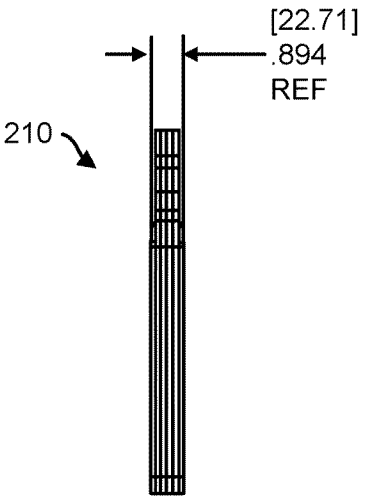
FIG. 25 is a front view of the inner hinge plate assembly.

The hinge comprises an outer hinge plate assembly 200, as shown in FIGS. 2022, having a left outer hinge plate 202, an outer hinge plate spacer 206 attached to the left outer hinge plate 202, and a right outer hinge plate 204 attached to the outer hinge plate spacer 206 with the outer hinge plate spacer 206 disposed between the right and left outer hinge plates 204, 202, and a stop rivet 208 attached to and extending between the right and left outer hinge plates 202, 204 and at least 0.5 inches from an outer surface of the right and left outer hinge plates 204, 202 and disposed above the outer hinge plate spacer 206. The left and right outer hinge plates 202, 204 defining a gap 218 between them. The hinge comprises an inner hinge plate assembly 210, as shown in FIGS. 23-25, having a left inner hinge plate 212, a center inner hinge plate spacer 216 attached to the left inner hinge plate 212, and a right inner hinge plate 214 attached to the center inner hinge plate spacer 216 with the center inner hinge plate spacer 216 disposed between the right and left inner hinge plates 214, 212. The left and right inner hinge plates 212, 214 and the center inner hinge plate spacer 216 disposed in the gap 218 of the outer hinge plate assembly 200 each having a groove 220 in alignment. The articulated hinge comprises a pin 222 which extends through the left and right outer hinge plates 202, 204 and the left and right inner hinge plates 212, 214 and the center inner hinge plate spacer 216. The left and right outer hinge plates 202, 204 rotate about the pin 222 relative to the left and right outer hinge plates 202, 204 and the center inner hinge plate. When the left and right outer hinge plates 202, 204 rotate to a fully extended position relative to the left and right inner hinge plates 212, 214 and the center inner hinge plate each groove 220 abuts the stop rivet 208 and is stopped by the stop rivet 208 from further rotation. As indicated above, the safety stop created by the stop rivet 208 is hidden well within the hinge to eliminate in the pinch point, as shown in FIG. 19.

The left and right inner and outer hinge plates and spacers each have a stem 224, as shown in FIGS. 20-25, that engages with the inner rails with the stem 224 inserted into and disposed into the hollow box of the inner rails and riveted in place with rivets 226 through the web 92 of the inner rail and the stem 224. Extending from the stem 224 of the left and right inner and outer hinge plates is a neck 228 which transitions to a connection portion 230, that has a circular shape with a pin hole 232 at about the center of the connection portion 230 to receive the pin 222. The left and right inner and outer hinge plates at about the center of the neck 228 is a stop rivet hole 234 through which the stop rivet 208 is disposed, and adjacent the bottom of the stem 224 is a cutout 240 where material has been removed to lessen the overall weight of the ladder. The left and right inner hinge plates 212, 214 also have cutouts 240 at about the center of their neck 228. The safety stop position of the hinge was moved to put it inside of the hinge plate assemblies which eliminates a pinch point that other MT ladders have. The inner hinge plate assembly 210 has left and right inner hinge plate spacers 236, 238, with the left inner hinge plate spacer 236 in direct contact with the left inner hinge plate 212, and the right inner hinge plate spacer 238 in direct contact with the right inner hinge plate 214, with the left and right inner hinge plates 212, 214 and the center inner hinge plate spacer 216 disposed between the left and right inner hinge plate spacers 236, 238. The spacers were made of plastic or polypropylene. The outer hinge plate spacer 206 is between 0.6 and 0.7 inches thick. The center inner hinge plate spacer 216 is between 0.2 and 0.3 inches think. The left and right inner hinge plate spacers are between 0.13 and 0.15 inches thick. The left and right inner hinge plates are between 0.13 and 0.16 inches thick. The left and right outer hinge plates are between 0.13 and 0.14 inches thick. The outer hinge plate assembly 200 is between 0.7 and 0.9 inches thick. The inner hinge plate assembly is between 0.7 and 0.9 inches thick.

The hinge plate thicknesses were minimized to reduce weight. In order to pass ANSI testing, two design changes regarding the hinge were required.

1) The hinge plate alloy of the 18', 22', and 26' ladders was changed from 6061-T6 to 7N01-T5 which is a stronger alloy.

2) Spacers were added to maintain distance between the hinge plates. This improves the I value of the assembly in the horizontal direction.

Cutouts 240 were added to the hinge plates to remove material in locations where it was unneeded for strength in order to lighten the parts. The 14 foot and 18 foot MT ladders 10 use semi-tube rivets 226 and have a different hole pattern than the 22 foot and 26 foot MT ladders 10. The 22 foot and 26 foot MT ladders use solid rivets 226 due to higher stresses experienced during testing.

Figure 26:
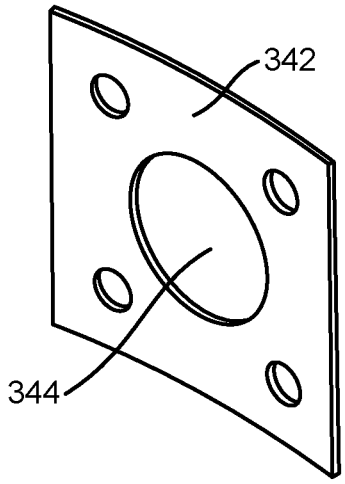
FIG. 26 is a perspective view of the J-lock plate.
Figure 27:
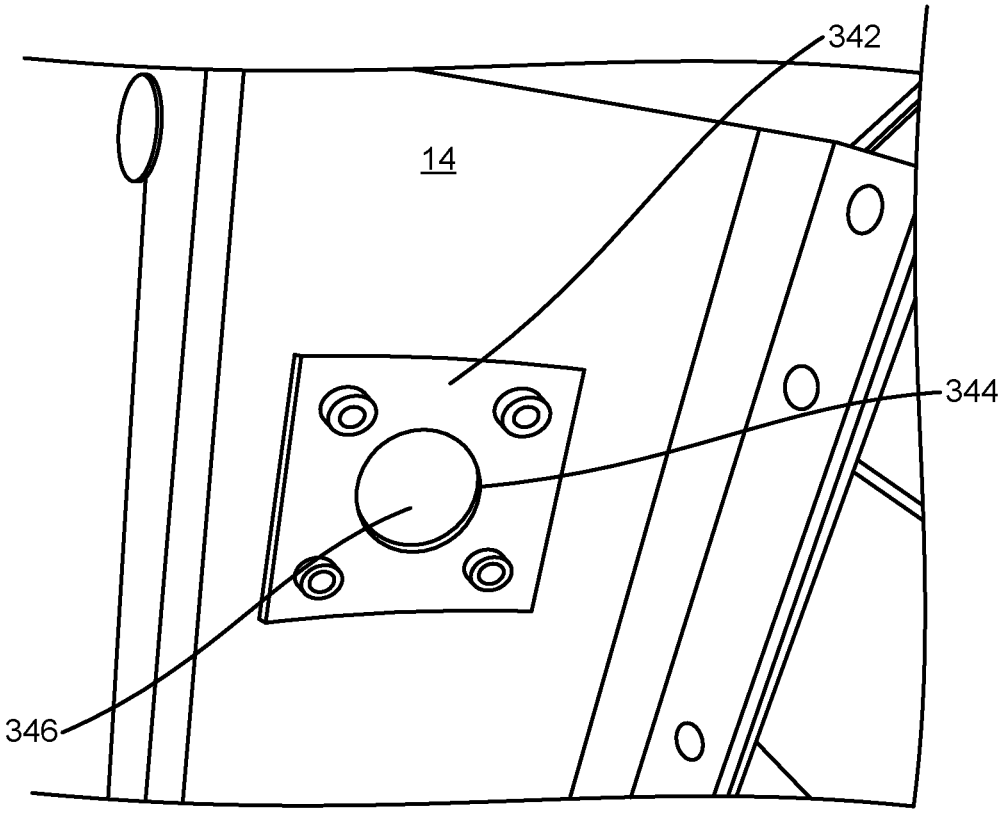
FIG. 27 shows a J-lock plate attached to an outer rail.

A J lock reinforcing plate 242 made of metal, such as aluminum, has a J lock plate hole 244 and is attached with rivets 226 to the inside of the outer rail so the J lock plate hole 244 aligns with the J lock outer rail hole 246 so the J lock fits in and extends through the J lock plate hole 244 and the J lock outer rail hole 246, as shown in FIGS. 1, 26 and 27. The J lock reinforcing plate 242 was added to the inside of the outer rail to provide additional strength around the J lock in order to pass ANSI load tests such as the Step to Siderail Shear test. This design change was necessitated by the 0.040" thick outer rail web. The thickness of the J lock reinforcing plate 242 is between 0.3 and 0.4 inches thick and preferably 0.36 inches thick. It is about 1.6 inches long by 1.6 inches wide and has rectangular or square shape. Preferably 4 rivets 226 attach the J lock reinforcing plate 242 to the outer rail.

Tests that are required for the MT ladder to pass to be ANSI IAA rated, besides being able to support loads of 375 lbs., include the following:

Step-to-siderail shear test: 1200 lbf applied for 60 sec to the side of each rung that has a different profile and no component of the ladder fails. Ladder in step ladder mode.

Single lock (J lock) test: 1200 lbf applied for 60 sec evenly to rung immediately above the J lock and no component of the ladder fails. Ladder in full extension mode and leaning against a wall.

Horizontal bend ultimate 1 position: 460 lbf applied for 60 sec to the rung closest to the center of the ladder 10 and no component of the ladder fails. Ladder in full extension mode and supported horizontally at both ends.

Column and hardware load test: 1500 lbf applied for 60 sec to the top rung of the ladder 10 and no component of the ladder fails. Ladder in full extension mode and leaning against a wall.

Figure 8:
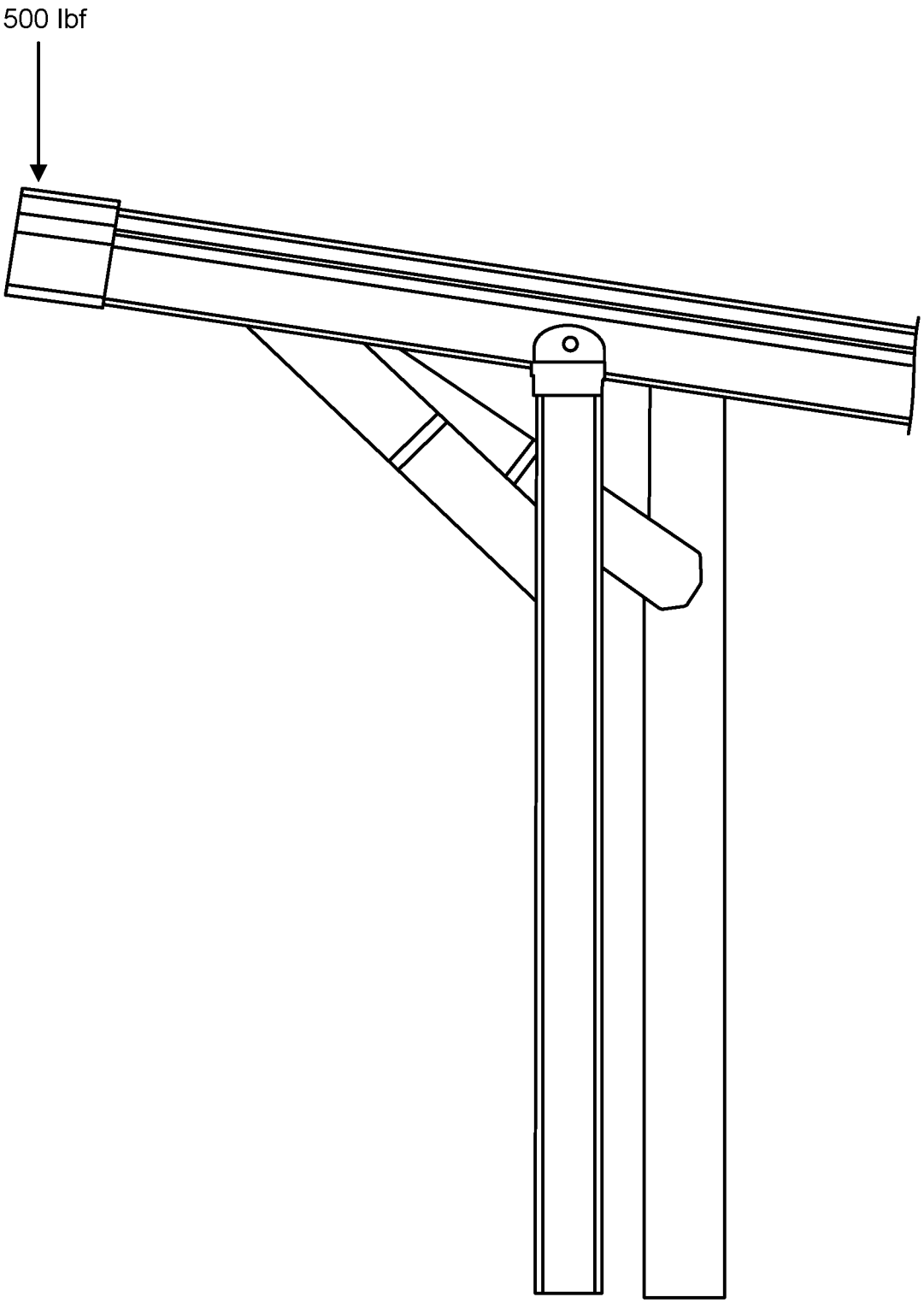
FIG. 8 shows the cantilever bend test loading. Test load is 500 lbf for IA and 600 lbf for IAA.
Figure 11:
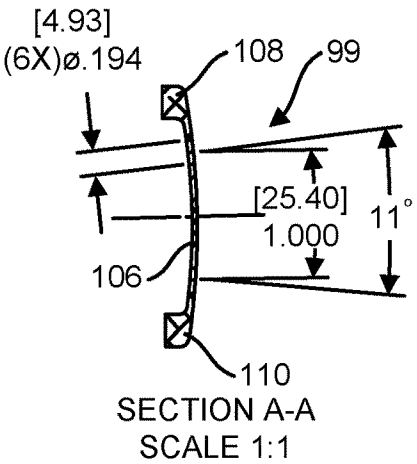
FIG. 11 is a cross-sectional view of the reinforcement plate.
Figure 9:
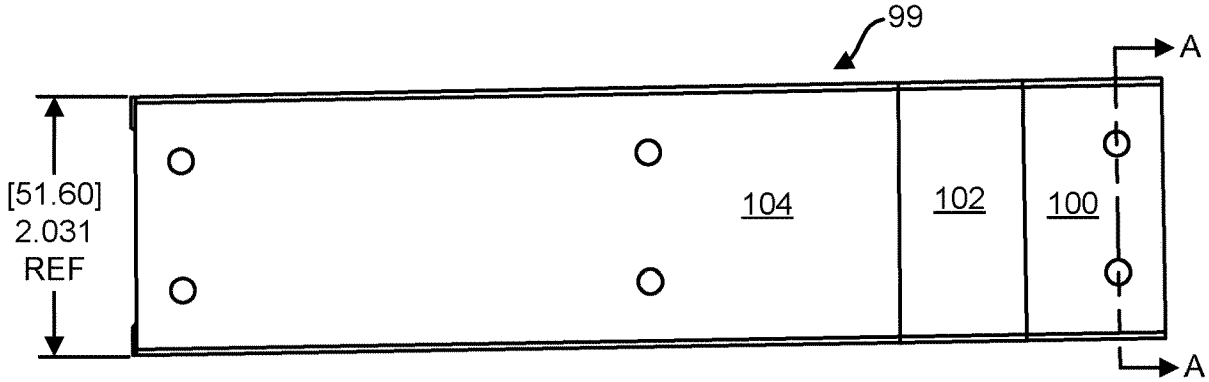
FIG. 9 is an overhead view of the reinforcement plate.
Figure 10:
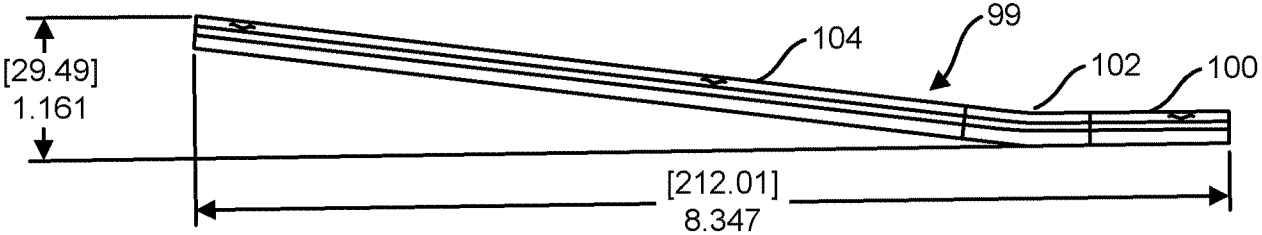
FIG. 10 is a side view of the reinforcement plate.
Figure 12:
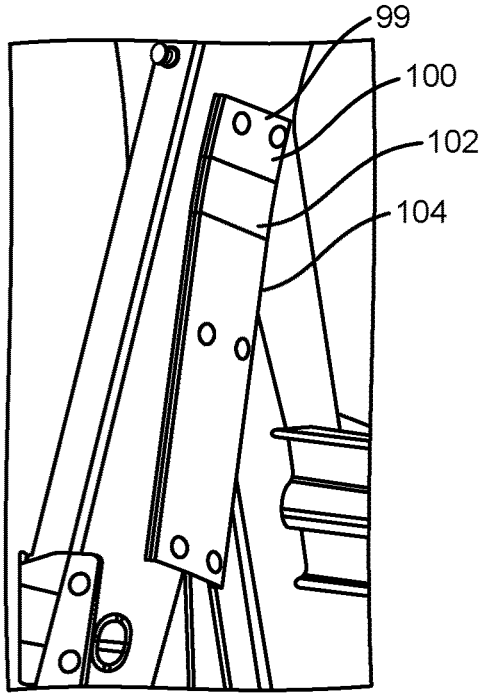
FIG. 12 shows the reinforcement plate relative to the inner rail with the outer rail hidden.
Figure 13:
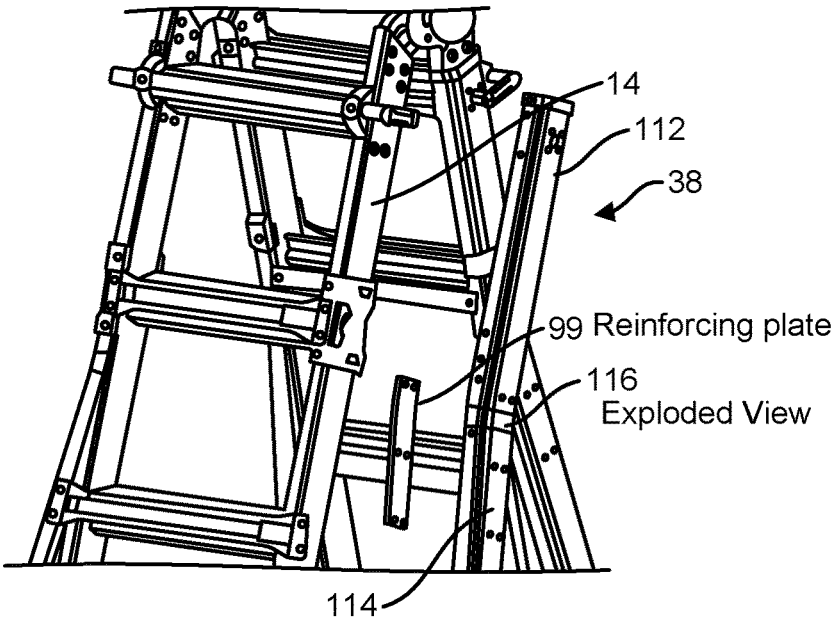
FIG. 13 shows an exploded view of the multipurpose ladder in regard to the reinforcement plate and the outer rail.

Cantilever bend test: Test load is 500 lbf for IA and 600 lbf for IAA and is applied at a right angle to the bottom 70 of the first right outer rail 38 of the ladder 10 at the web 86, as shown in FIG. 8, and the first right outer rail 38 of the ladder 10 does not fail.

The MT ladder 10 passes all of these tests.

Examples of multipurpose ladders 10 with a weight to length ratio are as follows:

| Werner Model | Extended Rail Length | Weight | Weight Ratio |
|---|---|---|---|
| HSMT 14' IA | 10.9 ft | 20.6 lbs | 1.89 lbs/ft |
| HSMT 18' IA | 14.8 ft | 27.6 lbs | 1.87 lbs/ft |
| HSMT 22' IA | 19.0 ft | 34.1 lbs | 1.80 lbs/ft |
| HSMT 26' IA | 23.0 ft | 44.1 lbs | 1.92 lbs/ft |
| HSMT 14' IAA | 10.9 ft | 23.5 lbs | 2.16 lbs/ft |
| HSMT 18' IAA | 14.8 ft | 32.1 lbs | 2.17 lbs/ft |
| HSMT 22' IAA | 19.0 ft | 38.9 lbs | 2.05 lbs/ft |
| HSMT 26' IAA | 23.0 ft | 50.2 lbs | 2.18 lbs/ft |

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A multipurpose ladder comprising:

a first inner section having a first inner right rail, a first inner left rail in parallel and spaced relation with the first inner right rail and a plurality of first inner rungs attached to the first inner left rail and the first inner right rail;

a first outer section having a first outer right rail, and a first outer left rail in parallel and spaced relation with the first outer right rail and a plurality of first outer rungs attached to the first outer left rail and the first outer right rail, the first outer right rail disposed about the first inner right rail, the first outer right rail having a bend of at least 7° outward relative to the first inner right rail which defines a lower portion of the first outer right rail below the bend;

a first locking bar attached to the first outer section which locks the first inner right rail in place relative to the first outer right rail in a locked state and allows the first inner right rail to slide relative to the first outer right rail in an unlocked state;

a first bracket that at least partially surrounds the first outer right rail, an entirety of the first bracket positioned above the first locking bar;

a second bracket that at least partially surrounds the first outer right rail, an entirety of the second bracket positioned below the first locking bar and above a second highest of the plurality of first outer rungs; and a third bracket that at least partially surrounds the first outer right rail, an entirety of the third bracket positioned below the second highest of the plurality of first outer rungs.

2. The multipurpose ladder of claim 1 having a weight to length ratio of less than 2.41 lbs/ft as a 14' IAA ANSI duty rated multipurpose ladder or a weight to length ratio of less than 2.27 lbs/ft as a 18' IAA ANSI duty rated multipurpose ladder or a weight to length ratio of less than 2.08 lbs/ft as a 22' IAA ANSI duty rated multipurpose ladder or a weight to length ratio of less than 2.34 lbs/ft as a 26' IAA ANSI duty rated multipurpose ladder or a weight to length ratio of less than 2.0 lbs/ft as a 14' IA ANSI duty rated multipurpose ladder or a weight to length ratio of less than 2.00 lbs/ft as a 18' IA ANSI duty rated multipurpose ladder or a weight to length ratio of less than 1.90 lbs/ft as a 22' IA ANSI duty rated multipurpose ladder or a weight to length ratio of less than 2.00 lbs/ft as a 26' IA ANSI duty rated multipurpose ladder.

3. The multipurpose ladder of claim 1, wherein the first bracket has a shape which conforms with a cross sectional shape of the first outer right rail; and the first bracket having a first bracket flange spaced from a second bracket flange by a bracket web and the first outer right rail having a first rail flange spaced from a second rail flange by a rail web, wherein the first bracket flange contacts the first rail flange and the second bracket flange contacts the second rail flange.

4. The multipurpose ladder of claim 1, wherein the second bracket has a shape which conforms with a cross-sectional shape of the first outer right rail.

5. The multipurpose ladder of claim 1, wherein the third bracket has a shape which conforms with a cross-sectional shape of the first outer right rail.

6. The multipurpose ladder of claim 1, further including a fourth bracket that at least partially surrounds the first outer right rail and disposed adjacent a bottom of the first outer right rail, the fourth bracket having a shape which conforms with a cross-sectional shape of the first outer right rail.

7. The multipurpose ladder of claim 6 further including a lower cross brace attached to the first outer right rail and the first outer left rail adjacent the bottom of the first outer right rail and the first outer left rail, and a fifth bracket disposed inside the first outer right rail and attached to the first outer right rail at a location where the lower cross brace is attached to the first outer right rail, the fifth bracket having a shape which conforms with a cross sectional shape of the first outer right rail.

8. The multipurpose ladder of claim 7, further including a sixth bracket disposed inside the first outer right rail and attached to the first outer right rail below the fifth bracket and above the fourth bracket, the sixth bracket having a shape which conforms with the cross-sectional shape of the first outer right rail.

9. The multipurpose ladder of claim 1 wherein the multipurpose ladder further includes a first articulated hinge attached to the first inner right rail with a first set of fasteners, and wherein the first articulated hinge includes an outer hinge spacer having bolt holes through which bolts extend to attach the first articulated hinge to the first outer right rail, the bolt holes of the outer hinge spacer having buttressing about each bolt hole, where the buttressing causes the outer hinge spacer to be thicker than areas where there is no buttressing, the buttressing strengthening the outer hinge spacer against cracking or failure from forces applied to the bolts.

10. The multipurpose ladder of claim 1 wherein the first outer right rail has a web and a first flange extending perpendicularly from the web and a second flange extending perpendicularly from the web and in parallel and spaced relation with the first flange, and wherein the first bracket has a web and a first flange extending perpendicularly from the web and a second flange extending perpendicularly from the web and in parallel and spaced relation with the first flange of the first bracket, the web of the first bracket contacts and conforms with the web of the first outer right rail, the first flange of the first bracket contacts and conforms with the first bracket of the first outer right rail and the second flange of the second bracket contacts and conforms with the second flange of the first outer right rail.

11. A ladder comprising:

a first inner section having a first inner right rail, a first inner left rail in parallel and spaced relation with the first inner right rail and a plurality of first inner rungs attached to the first inner left rail and the first inner right rail;

a second inner section having a second inner right rail, and a second inner left rail in parallel and spaced relation with the second inner right rail and a plurality of second inner rungs attached to the second inner left rail and the second inner right rail;

a first outer section having a first outer right rail, and a first outer left rail in parallel and spaced relation with the first outer right rail and a plurality of first outer rungs attached to the first outer left rail and the first outer right rail, the first outer right rail having a bend of at least 7° outward relative to the first inner right rail which defines a lower portion below the bend;

a second outer section having a second outer right rail, and a second outer left rail in parallel and spaced relation with the second outer right rail and a plurality of second outer rungs attached to the second outer left rail and the second outer right rail, the second outer right rail disposed about the second inner right rail with the second inner right rail sliding up and down relative to the second outer right rail;

a plurality of brackets disposed about the first outer right rail, and the first outer left rail, and the second outer right rail, and the second outer left rail, the plurality of brackets providing support to each of the outer right rails and outer left rails and strengthens them against bending forces; and a reinforcement plate disposed between the first outer right rail and the first inner right rail, the reinforcement plate conforming to a web of the first outer right rail, the reinforcement plate further having a bend aligned with the bend of the first outer right rail.

12. The ladder of claim 11 wherein the first outer right rail and the second outer right rail and the first outer left rail and the second outer left rail each have a web that is less than 0.041 inches thick; and wherein the plurality of brackets includes a first bracket having a first bracket flange spaced from a second bracket flange by a bracket web and the first outer right rail having a first rail flange spaced from a second rail flange by a rail web, wherein the first bracket flange contacts the first rail flange and the second bracket flange contacts the second rail flange.

13. The ladder of claim 11 having an ANSI duty rating of at least 1A and supports at least 300 lbs. of load without failing.

14. The ladder of claim 11 wherein the first inner right rail and the first inner left rail have holes, and a first rung of the plurality of first inner rungs have nubs at each end of the first rung which fit into the holes of the first inner right rail and the first inner left rail.

15. The ladder of claim 14 wherein the first rung comprises a hollow center portion; a top web which extends upwards from the hollow center portion, and a top flange having a flat surface on which a user can place a foot to stand on, the top flange is attached to the top web at an acute angle with the top web so the flat surface faces away from a center of the ladder with the top web between the top flange and the hollow center portion, the top web is less than 0.041 inches thick, the first rung comprises a bottom web which extends downwards from the hollow center portion, and a bottom flange having a flat surface on which a user can place a foot to stand on, the bottom flange is attached to the bottom web at an acute angle with the bottom web so the flat surface of the bottom flange faces away from the center of the ladder with the bottom web between the bottom flange and the hollow center portion, the bottom web is less than 0.041 inches thick, the hollow center portion extends beyond the top flange and the bottom flange of the first rung so the hollow center portion extends through the first inner right rail and the first inner left rail and is swaged to them to fix the first rung in place.

16. The ladder of claim 11, further including a first articulated hinge attached to the first inner right rail with a first set of fasteners, and wherein the first articulated hinge comprises an outer hinge plate assembly having a left outer hinge plate, an outer hinge plate spacer attached to the left outer hinge plate, and a right outer hinge plate attached to the outer hinge plate spacer with the outer hinge plate spacer disposed between the right outer hinge plate and the left outer hinge plate, and a rivet attached to and extending between the right outer hinge plate and the left outer hinge plate and at least 0.5 inches from an outer surface of the right outer hinge plate and the left outer hinge plate and disposed above the outer hinge plate spacer, the left outer hinge plate and the right outer hinge plate defining a gap between them; an inner hinge plate assembly having a left inner hinge plate, a center inner hinge plate spacer attached to the left inner hinge plate, and a right inner hinge plate attached to the center inner hinge plate spacer with the center inner hinge plate spacer disposed between the right inner hinge plate and the left inner hinge plate, the left inner hinge plate and the right inner hinge plate and the center inner hinge plate spacer disposed in the gap of the outer hinge plate assembly each having a groove in alignment; and a pin which extends through the left outer hinge plate and the right outer hinge plate and the left inner hinge plate and the right inner hinge plate and the center inner hinge plate spacer, the left outer hinge plate and the right outer hinge plate rotate about the pin relative to the left outer hinge plate and the right outer hinge plate and a center inner hinge plate, when the left outer hinge plate and the right outer hinge plate rotate to a fully extended position relative to the left inner hinge plate and the right inner hinge plate and the center inner hinge plate each groove abuts the rivet and is stopped by the rivet from further rotation.

17. The ladder of claim 11, further including a first locking bar attached to the first outer section which locks the first inner right rail in place relative to the first outer right rail in a locked state and allows the first inner right rail to slide relative to the first outer right rail in an unlocked state, wherein the first locking bar includes a J lock and a J lock reinforcing plate made of metal having a J lock plate hole which is attached with rivets to an inside of the first outer right rail so the J lock plate hole aligns with a J lock outer rail hole so the J lock fits in and extends through the J lock plate hole and the J lock outer rail hole.

18. The ladder of claim 17 having an ANSI duty rating of at least 1AA and supports at least 375 lbs. of load without failing and which passes a step-to-siderail shear test, where 1200 lbf are applied for 60 sec to a side of each rung that has a different profile and no component of the ladder fails; a single lock (J lock) test, where 1200 lbf is applied for 60 sec evenly to a rung immediately above the J lock and no component of the ladder fails and the ladder is in full extension mode and leaning against a wall; a horizontal bend ultimate 1 position test where 460 lbf are applied for 60 sec to a rung closest to a center of the ladder and no component of the ladder fails and the ladder is in full extension mode and supported horizontally at both ends; a column and hardware load test where 1500 lbf are applied for 60 sec to a top rung of the ladder and no component of the ladder fails and the ladder is in full extension mode and leaning against a wall; and a cantilever bend test, where 500 lbf are applied at a right angle to a bottom of the first outer right rail at the web, and the first outer right rail does not fail.

19. A multipurpose ladder comprising:

a first inner section having a first inner right rail, a first inner left rail in parallel and spaced relation with the first inner right rail and a plurality of first inner rungs attached to the first inner left rail and the first inner right rail;

a first outer section haying a first outer right rail, and a first outer left rail in parallel and spaced relation with the first outer right rail and a plurality of first outer rungs attached to the first outer left rail and the first outer right rail, the first outer right rail disposed about the first inner right rail, the first outer right rail having a bend of at least 7° outward relative to the first inner right rail which defines a lower portion below the bend;

a plurality of brackets disposed about the first outer right rail, and the first outer left rail, the plurality of brackets providing support to each of the outer right rails and outer left rails and strengthens them against bending forces; and a reinforcement plate disposed inside and in contact with the first outer right rail and in alignment with the first outer right rail, the reinforcement plate and the first outer right rail each having an upper section and a bend connected to the upper section, and a lower section connected to the bend with the bend between the upper section and the lower section, the bend of the reinforcement plate and the bend of the first outer right rail being in contact, the upper section of the reinforcement plate and the upper section of the first outer right rail being in contact, the lower section of the reinforcement plate and the lower section of the first outer right rail being in contact.

20. The multipurpose ladder of claim 19 having an ANSI duty rating of at least 1A and supports at least 300 lbs. of load without failing.

21. The multipurpose ladder of claim 19, further including:

a first articulated hinge attached to the first inner right rail with a first set of fasteners;

a second articulated hinge attached to the first inner left rail with a second set of fasteners; and a second inner section having a second inner right rail, and a second inner left rail in parallel and spaced relation with the second inner right rail and a plurality of second inner rungs attached to the second inner left rail and the second inner right rail, the second inner right rail attached to the first articulated hinge and the second inner left rail attached to the second articulated hinge so the second inner section can rotate about the first articulated hinge and the second articulated hinge at least 80° relative to the first inner section, the first outer right rail and the first outer left rail each have a web that is less than 0.041 inches thick.

22. The multipurpose ladder of claim 19, further including:

a first locking bar attached to the first outer section which locks the first inner right rail in place relative to the first outer right rail in a locked state and al lows the first inner right rail to slide relative to the first outer right rail in an unlocked state; and a first bracket that at least partially surrounds the first outer right rail, an entirety of the first bracket positioned above the first locking bar.

* * * * *